US010906714B2

(12) United States Patent
Chen

(10) Patent No.: US 10,906,714 B2
(45) Date of Patent: Feb. 2, 2021

(54) TOOL HOLDER

(71) Applicant: Chao-Ming Chen, Taichung (TW)

(72) Inventor: Chao-Ming Chen, Taichung (TW)

( * ) Notice: Subject to any disclaimer, the term of this patent is extended or adjusted under 35 U.S.C. 154(b) by 424 days.

(21) Appl. No.: 15/259,083

(22) Filed: Sep. 8, 2016

(65) Prior Publication Data

US 2018/0065792 A1 Mar. 8, 2018

(51) Int. Cl.
*B65D 79/02* (2006.01)
*B65D 73/00* (2006.01)
*B25H 3/00* (2006.01)

(52) U.S. Cl.
CPC ..... *B65D 73/0064* (2013.01); *B25H 3/003* (2013.01); *B65D 2211/00* (2013.01)

(58) Field of Classification Search
CPC .... B65D 73/0064; B65D 79/02; B25H 3/003; B25H 3/04; B25H 3/00
USPC ..... 206/378, 349, 372, 493
See application file for complete search history.

(56) References Cited

U.S. PATENT DOCUMENTS 5,740,911 A * 4/1998 Chou ..... A47F 5/0861 206/1.5
5,862,913 A * 1/1999 Chou ..... A47F 5/0823 206/378
5,897,001 A * 4/1999 Dembicks ..... B25B 13/56 206/378
6,092,655 A * 7/2000 Ernst ..... B25H 3/06 206/378
6,092,656 A * 7/2000 Ernst ..... B25H 3/06 206/378
6,415,933 B1 * 7/2002 Kao ..... B25H 3/003 206/378
6,508,360 B1 * 1/2003 Chen ..... B25H 3/003 206/349
8,307,980 B1 * 11/2012 Kao ..... B25H 3/04 206/372
8,381,905 B1 * 2/2013 Kao ..... B25H 3/003 206/1.5
8,387,791 B2 * 3/2013 Huang ..... B25H 3/022 206/378
8,864,097 B2 * 10/2014 Wang ..... F16M 13/005 248/551
2005/0116130 A1 * 6/2005 Hu ..... B65D 73/0064 248/309.1
2006/0254940 A1 * 11/2006 Mu ..... B25H 3/003 206/378

(Continued)

*Primary Examiner* — Robert Poon
(74) *Attorney, Agent, or Firm* — Alan D. Kamrath; Karin L. Williams; Mayer & Williams PC

(57) ABSTRACT

A tool holder contains: a connector and a fixer. The connector includes at least one body, and each of the at least one body has a first side plate, a second side plate, and a connection plate. The first side plate has a first fitting portion, and the second side plate has a second fitting portion. The first fitting portion and the second fitting portion define a square fitting zone, and the first side plate further has a first locking projection. Between the first fitting portion and the second fitting portion is defined a cavity so that the first fitting portion and the second fitting portion deform inwardly, and so that the first locking projection retract into the fitting zone. The fixer is housed in the cavity of the connector to limit an inward deformation of the first fitting portion and the second fitting portion.

9 Claims, 29 Drawing Sheets

(56) References Cited

U.S. PATENT DOCUMENTS

| | | | | |
|---|---|---|---|---|
| 2007/0193313 | A1* | 8/2007 | Tsai | B65D 73/0064 70/57.1 |
| 2009/0145865 | A1* | 6/2009 | Yu | B25H 3/003 211/70.6 |
| 2012/0118836 | A1* | 5/2012 | Wu | A47F 5/0006 211/4 |
| 2015/0034518 | A1* | 2/2015 | Kao | B25H 3/04 206/372 |
| 2015/0165615 | A1* | 6/2015 | Lee | B65D 25/22 206/372 |
| 2015/0183573 | A1* | 7/2015 | Chao-Ming | B65D 85/02 206/378 |
| 2016/0096264 | A1* | 4/2016 | Kao | B25H 3/06 206/378 |

* cited by examiner

A-A

B-B

C-C

TOOL HOLDER

FIELD OF THE INVENTION

The present invention relates to a tool holder which has an anti-theft effect and which removes or fits a tool easily.

BACKGROUND OF THE INVENTION

Socket sets of various sizes are mounted on a tool holder for display and storage.

Referring to FIGS. 1-2, a conventional tool holder 20 contains a plurality of bodies 21 and a fixing mount 22. Each body 21 has a fitting portion 211 extending upwardly from a top thereof and has a notch 212 defined on one side of the fitting portion 211 to accommodate a spring 213 and a steel ball 214, such that the spring 213 pushes the steel ball 214 to extend out of one side of the fitting portion 211. Each body 21 further has a slidable block 215 arranged on a bottom thereof, and the fixing mount 22 has an accommodation groove 221 defined thereon to house the slidable block 215 of each body 21. A fitting orifice 231 of each of multiple sockets 23 is fitted with the fitting portion 211 of each body 21, and the steel ball 214 retains with a recess 232 of the fitting orifice 231 of the socket 23, thus fitting the socket 23 with each body 21.

However, as displaying the tool holder 20, each socket 23 is removed from the fitting portion of each body 21 easily by a thief. Furthermore, after purchasing the tool holder 20, the steel ball 214 is pushed by the spring 213, so it is inconvenient to remove each socket 23 from each body 21.

The present invention has arisen to mitigate and/or obviate the afore-described disadvantages.

SUMMARY OF THE INVENTION

The primary objective of the present invention is to provide a tool holder which has an anti-theft effect when displaying the tool holder.

A further objective of the present invention is to provide a tool holder in which the fixer is cut after purchasing the tool holder, so that the first fitting portion of the first side plate and the second fitting portion of the second side plate deform inwardly, and so that the first locking projection and the second locking projection retract in the fitting zone defined by the first fitting portion and the second fitting portion to remove from the tool. The two diagonal corners of the tool correspond to the first locking projection to remove or fix the tool easily.

Another objective of the present invention is to provide a tool holder in which the fixer is cut after purchasing the tool holder, so that the first fitting portion of the first side plate and the second fitting portion of the second side plate deform inwardly, and so that the first locking projection retracts in the fitting zone defined by the first fitting portion and the second fitting portion to remove from the tool. The two diagonal corners of the tool correspond to the first locking projection, so that when removing or fixing the tool, the first locking projection is not scratched, thus prolonging the service life of the first locking projection.

To obtain the above objectives, a tool holder provided by the present invention contains: a connector and a fixer.

The connector includes at least one body, and each of the at least one body has a first side plate, a second side plate, and a connection plate connecting with a first end of the first side plate and a first end of the second side plate. The first side plate has a first fitting portion extending upwardly from a second end of the first side plate, and the second side plate has a second fitting portion extending upwardly from a second end of the second side plate. The first fitting portion and the second fitting portion define a square fitting zone, and the first side plate further has a first locking projection arranged on the first fitting portion thereof and extending out of the fitting zone. Between the first fitting portion and the second fitting portion is defined a cavity so that the first fitting portion and the second fitting portion deform inwardly, and so that the first locking projection retracts into the fitting zone.

The fixer is housed in the cavity of the connector to limit an inward deformation of the first fitting portion and the second fitting portion.

DETAILED DESCRIPTION OF THE PREFERRED EMBODIMENTS

Figure 1:
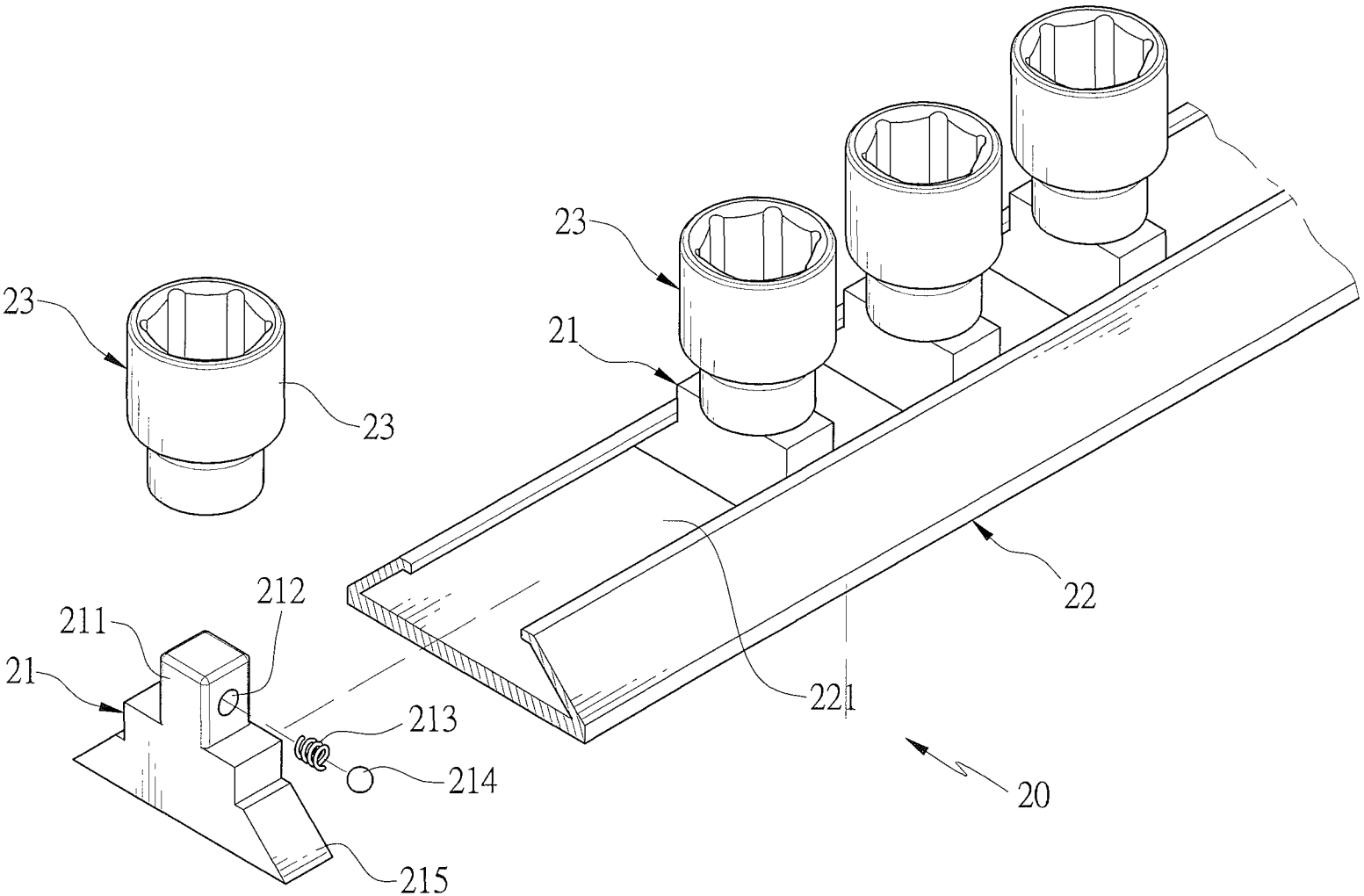
FIG. 1 PRIOR ART
FIG. 1 is a perspective view of a conventional tool holder.
Figure 2:
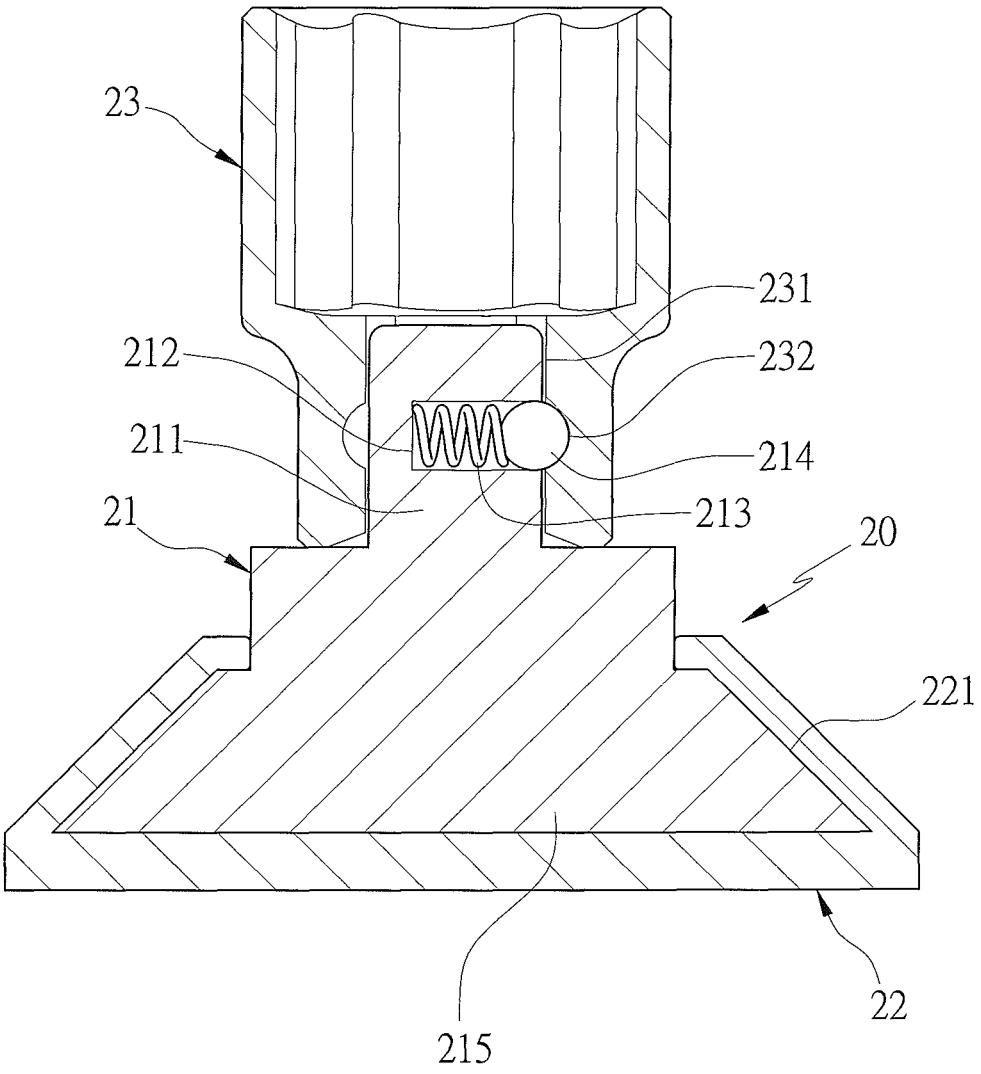
FIG. 2 PRIOR ART
FIG. 2 is a cross sectional view of the conventional tool holder.
Figure 3:
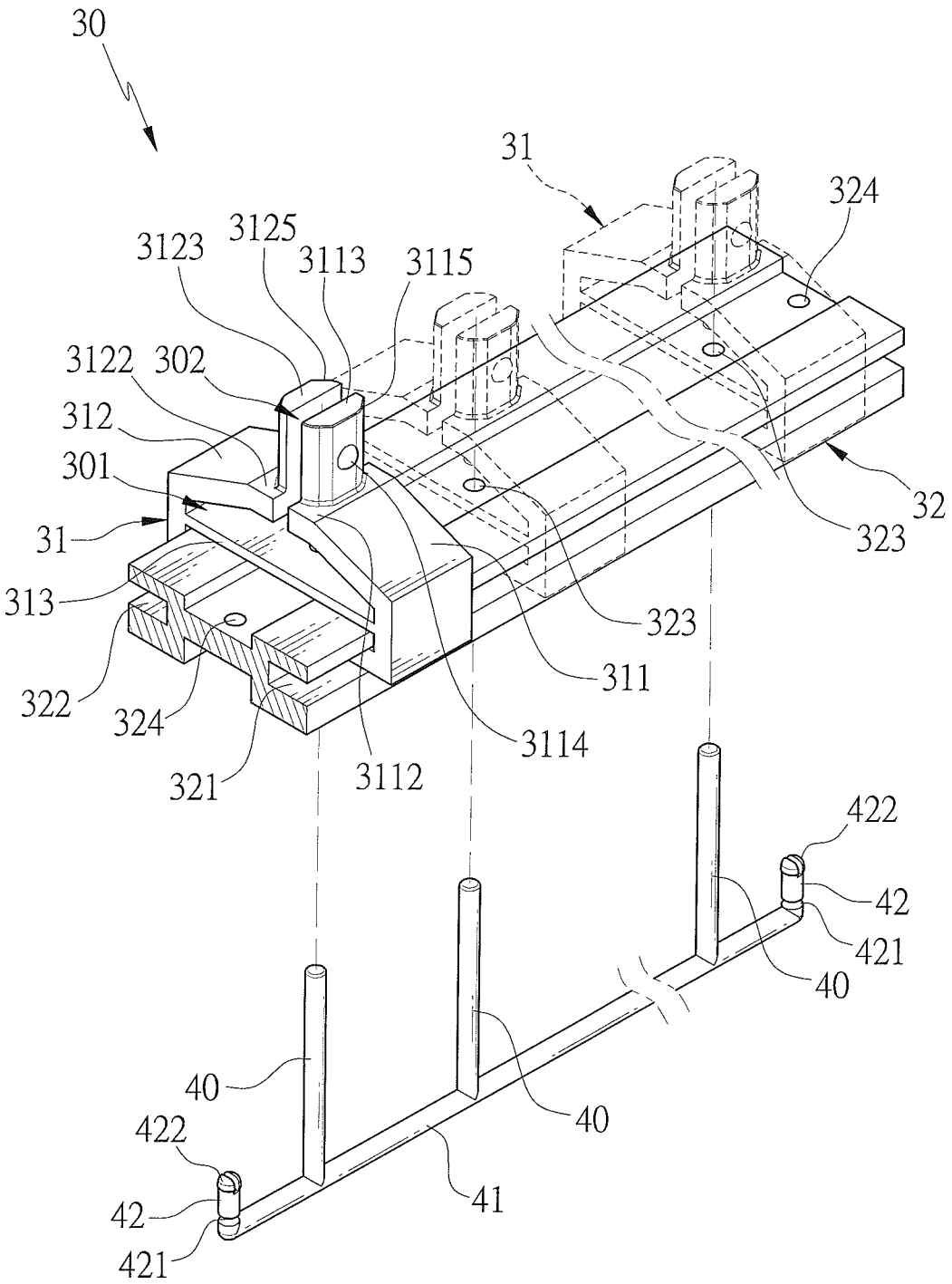
FIG. 3 is a perspective view showing the exploded components of a tool holder according to a first embodiment of the present invention.
Figure 4:
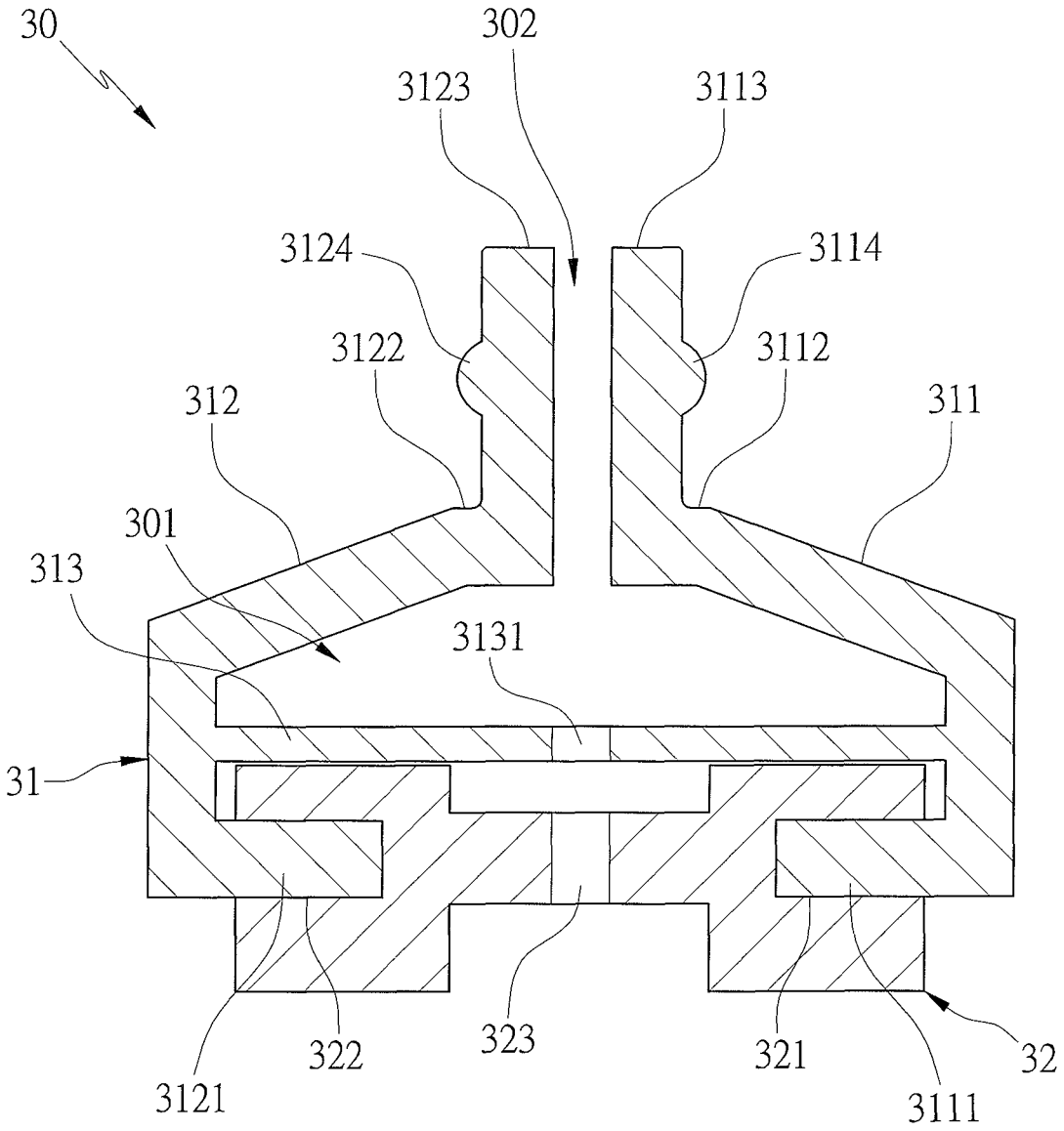
FIG. 4 is a cross sectional view showing the assembly of a part of the tool holder according to the first embodiment of the present invention.

With reference to FIGS. 3 and 4, a tool holder according to a first embodiment of the present invention comprises: a connector 30 and a fixer 40. The connector 30 includes at least one body 31, and each of the at least one body 31 has a first side plate 311, a second side plate 312, and a connection plate 313 connecting with a first end of the first side plate 311 and a first end of the second side plate 312. In this embodiment, the first end of the first side plate 311 and the first end of the second side plate 312 are in connection on a fixing mount 32. The first side plate 311 has a first extension 3111 bending inwardly from the first end thereof, and the second side plate 312 has a second extension 3121 bending inwardly from the first end thereof. The fixing mount 32 has a first accommodation groove 321 defined on a first side thereof to fit with the first extension 3111 of the first side plate 311, and the fixing mount 32 has a second accommodation groove 322 defined on a second side thereof to fit with the second extension 3121 of the second side plate 312. The fixing mount 32 has a predetermined length to fit with a plurality of bodies 31. The fixing mount 32 further has two covering members (not shown) arranged on two ends thereof respectively to limit the plurality of bodies 31 on the fixing mount 32. Since the two covering members are well-known prior art, further remarks are omitted.

The first side plate 311 and the second side plate 312 of each body 31 obliquely extend inward. In this embodiment, the first side plate 311 also has a first stop portion 3112 formed on a second end thereof and has a first fitting portion 3113 extending upwardly from the first stop portion 3112, and the second side plate 312 also has a second stop portion 3122 formed on a second end thereof and has a second fitting portion 3123 extending upwardly from the second stop portion 3122. The first fitting portion 3113 and the second fitting portion 3123 define a square fitting zone for fitting a tool. The first side plate 311 further has a first locking projection 3114 arranged on the first fitting portion 3113 thereof and extending out of the fitting zone defined by.the first fitting portion 3113 and the second fitting portion 3123. In this embodiment, the second side plate 312 has a second locking projection 3124 arranged on the second fitting portion 3123 thereof and corresponding to the first locking projection 3114. When the first fitting portion 3113 and the second fitting portion 3123 fit with the tool, the first stop portion 3112 and the second stop portion 3122 limit the tool, and the first locking projection 3114 and the second locking projection 3124 engage the tool. The first fitting portion 3113 has two first tilted faces 3115 defined on two edges of an outer rim thereof respectively, and the second fitting portion 3123 has two second tilted faces 3125 defined on two edges of an outer rim thereof respectively to guide the tool to rotate 45 degrees. Among the first side plate 311, the second side plate 312, and the connection plate 313 is defined a chamber 301, and between the first fitting portion 3113 and the second fitting portion 3123 is defined a cavity 302. Thus, the first side plate 311 and the second side plate 312 are forced to drive the first fitting portion 3113 and the second fitting portion 3123 to deform inwardly, and the first locking projection 3114 and the second locking projection 3124 retract into the fitting zone defined by the first fitting portion 3113 and the second fitting portion 3123 to release the tool.

The fixer 40 is housed in the cavity 302 of each body. 31 of the connector 30 to limit inward deformation of the first fitting portion 3113 of the first side plate 311 and the second fitting portion 3123 of the second side plate 312, and the first locking projection 3114 of the first fitting portion 3113 and the second locking projection 3124 of the second fitting portion 3123 engage the tool, thus obtaining an anti-theft effect of the tool. In this embodiment, the connection plate 313 has a through hole 3131 to accommodate the fixer 40. The plurality of bodies 31 is fitted on the fixing mount 32, the fixing mount 32 further has multiple orifices 323, and each orifice 323 is configured to accommodate the fixer 40.

In this embodiment, the fixer 40 includes a horizontal column 41 extending from a bottom end thereof, and the fixer 40 also includes two vertical columns 42 arranged on two edges of the horizontal column 41. Each of the two vertical columns 42 has a neck 421 formed on a first end thereof and a flexible fastening tab 422 arranged on a second end thereof The fixing mount 32 has multiple notches 324, and each of the multiple notches 324 accommodates the flexible fastening tab 422 of said each vertical column 42. Hence, the fixer 40 is mounted in the cavity 302 of the connector 30 to limit the inward deformation of the first fitting portion 3113 and the second fitting portion 3123, thus obtaining the anti-theft effect of the tool.

Figure 5:
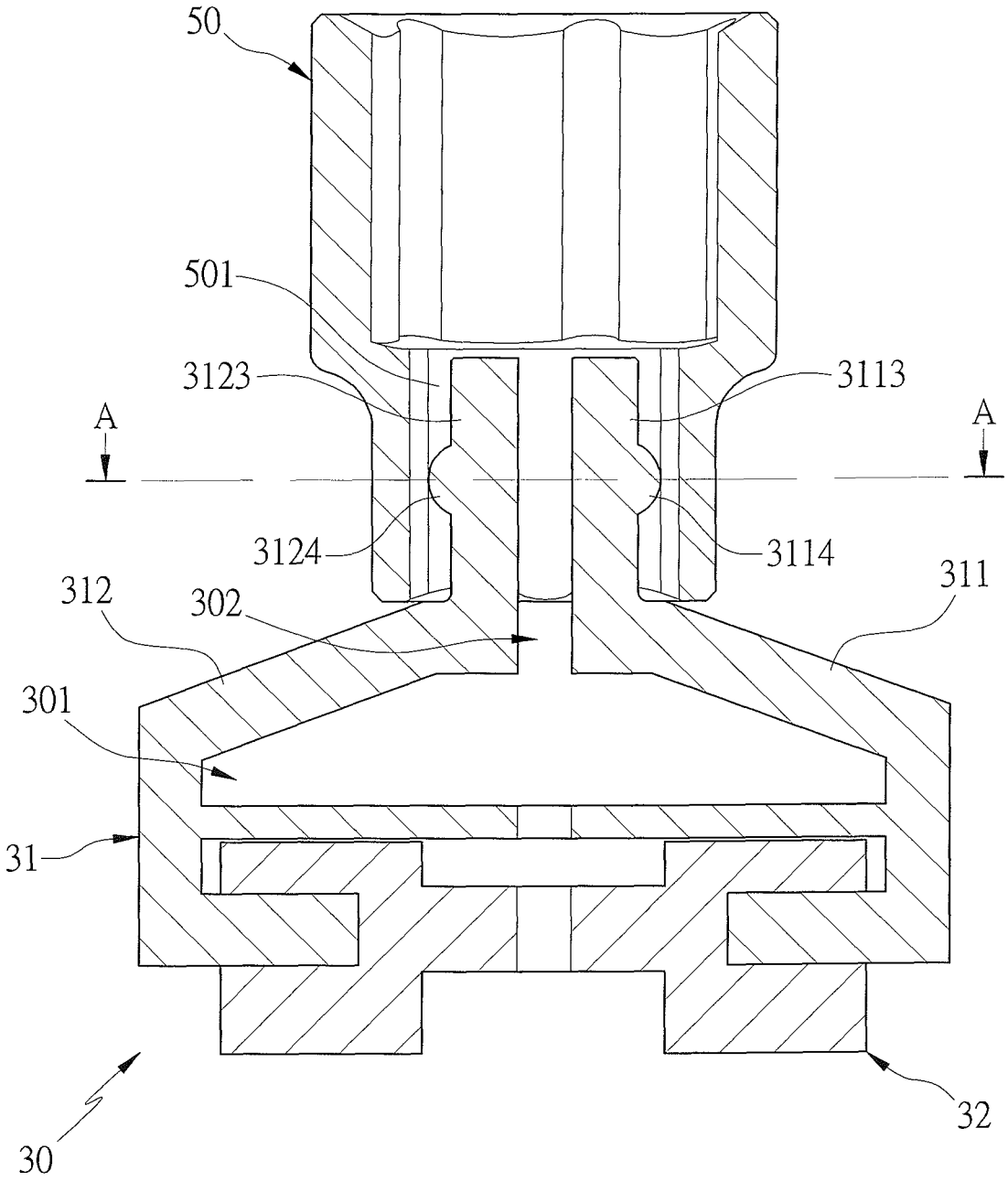
FIG. 5 is a cross sectional view showing the operation of a part of the tool holder according to the first embodiment of the present invention.
Figure 6:
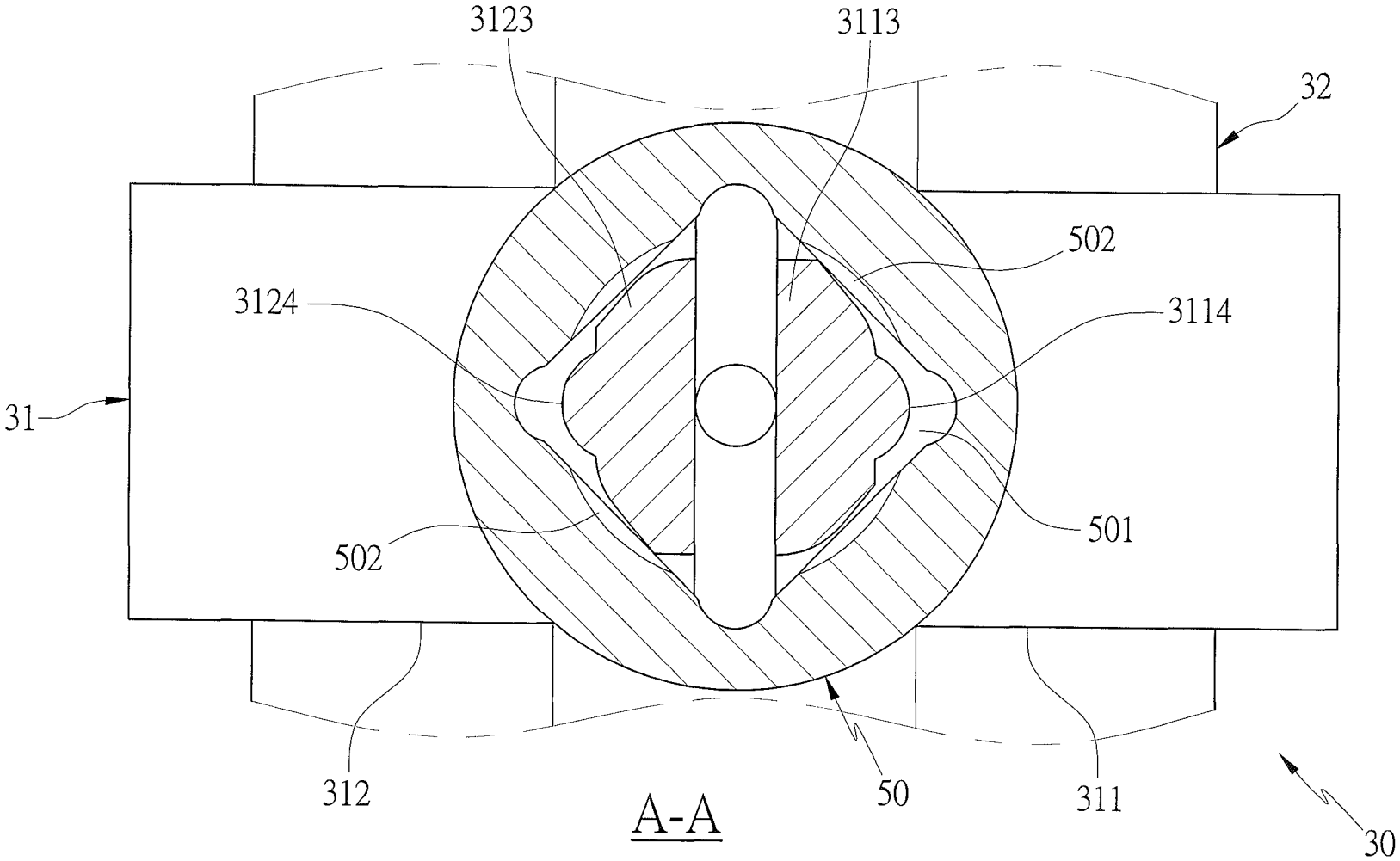
FIG. 6 is a cross sectional view taken along the line A-A of FIG. 5.

Referring to FIGS. 5 and 6, the tool is a socket or a connection rod. Taking the socket 50 for example, it has a square hole 501 defined on one end thereof to fit with the fitting zone defined by the first fitting portion 3113 and the second fitting portion 3123 of each body 31, and the square hole 501 has four retaining recesses 502 individually arranged on four peripheral walls thereof. Each retaining recess 502 retains with the first locking projection 3114 or the second locking projection 3124.

Two diagonal corners of the socket 50 correspond to the first locking projection 3114 and the second locking projection 3124. A distance between the two diagonal corners of the socket 50 is more than an extending length of each of the first locking projection 3114 and the second locking projection 3124, so the square hole 501 of the socket 50 fits with the first fitting portion 3113 and the second fitting portion 3123.

Figure 7:
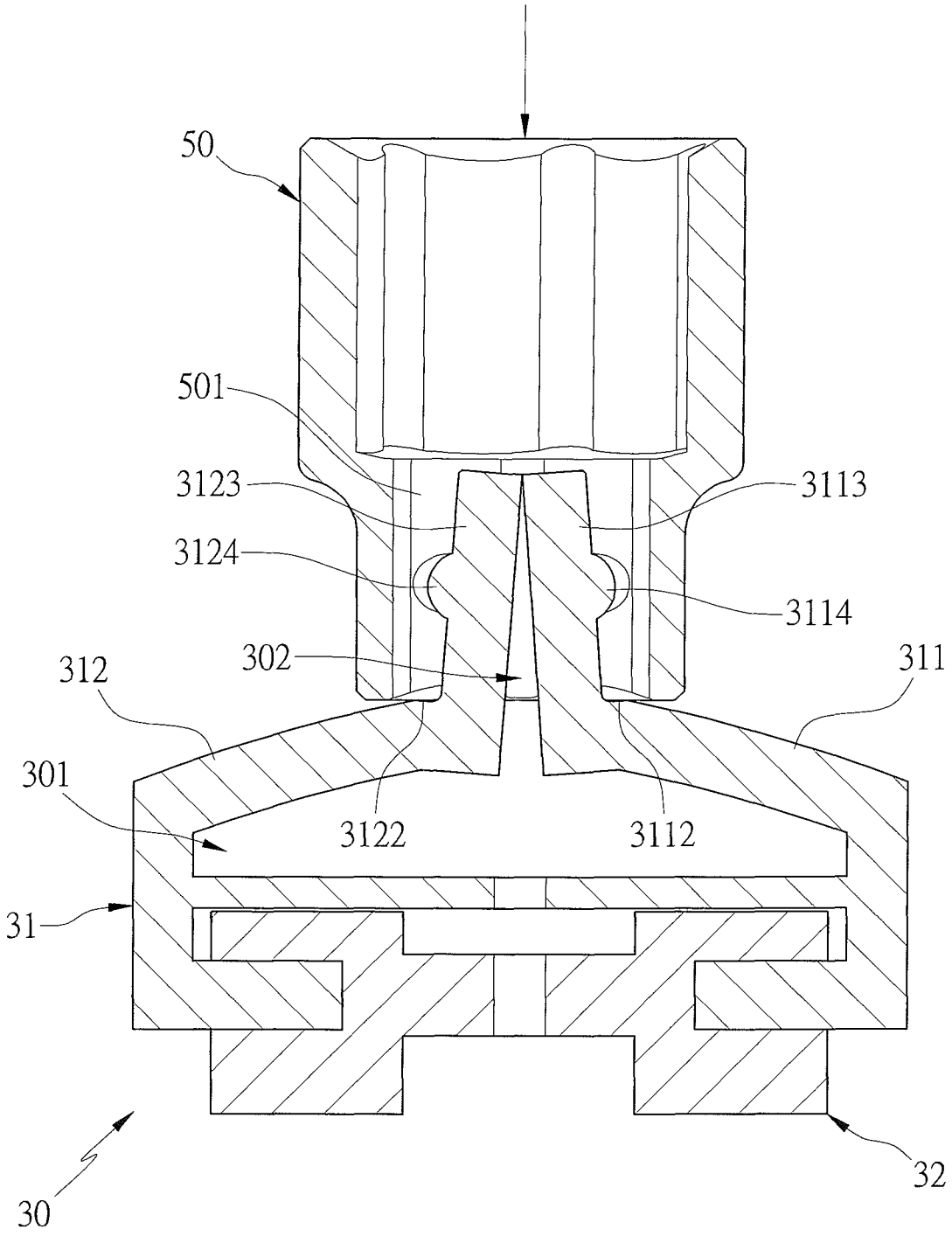
FIGS. 7 to 15 are cross sectional views respectively showing the operation of the tool holder according to the first embodiment of the present invention.

As illustrated in FIG. 7, the socket 50 is pressed to abut against the first stop portion 3112 of the first side plate 311 and the second stop portion 3122 of the second side plate 312, and the first side plate 311 and the second side plate 312 drive the first fitting portion 3113 and the second fitting portion 3123 to deform inwardly. Then, the first locking projection 3114 and the second locking projection 3124 retract into the fitting zone defined by the first fitting portion 3113 and the second fitting portion 3123.

Figure 8:
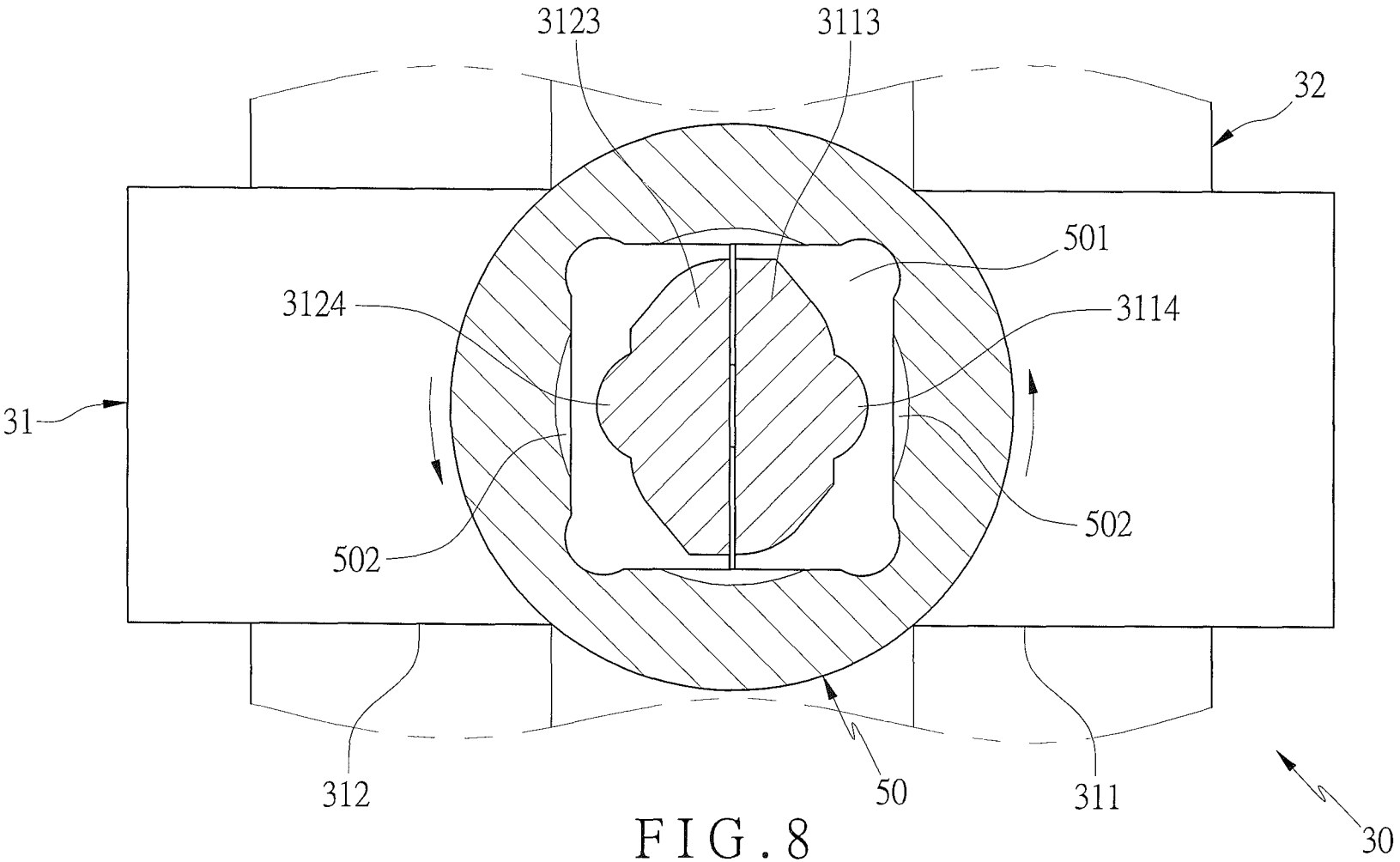
Figure 9:
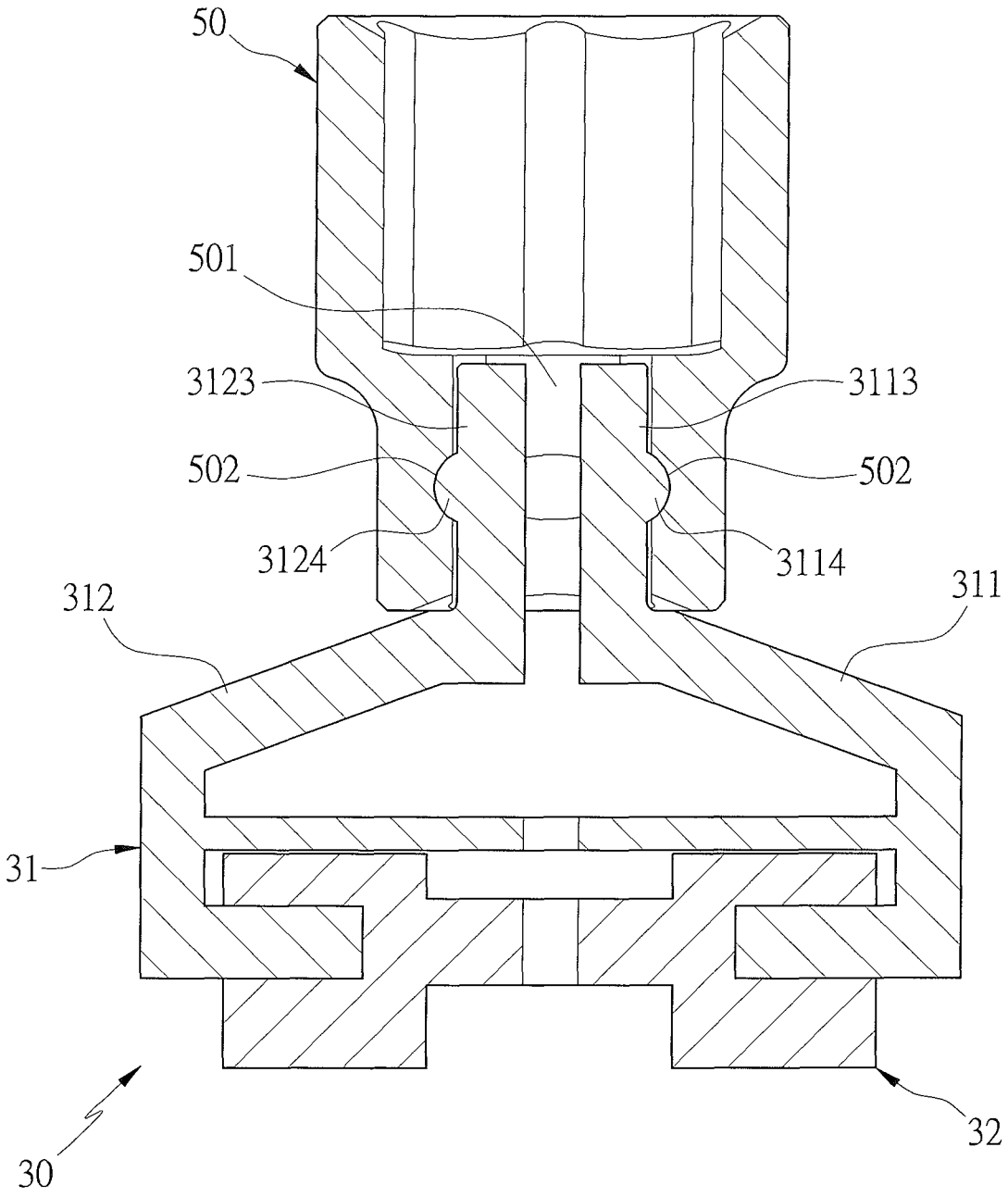
Figure 10:
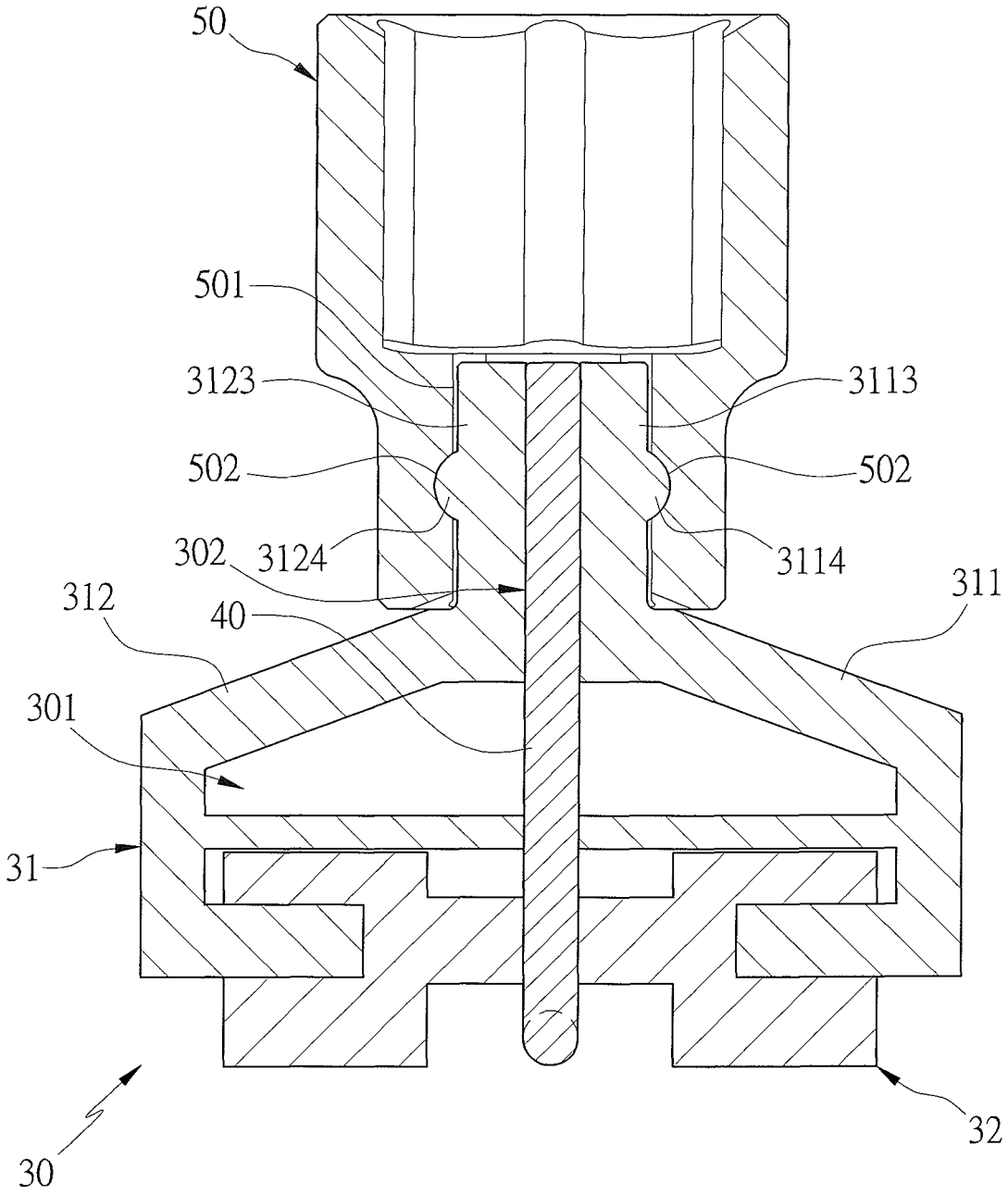
Figure 11:
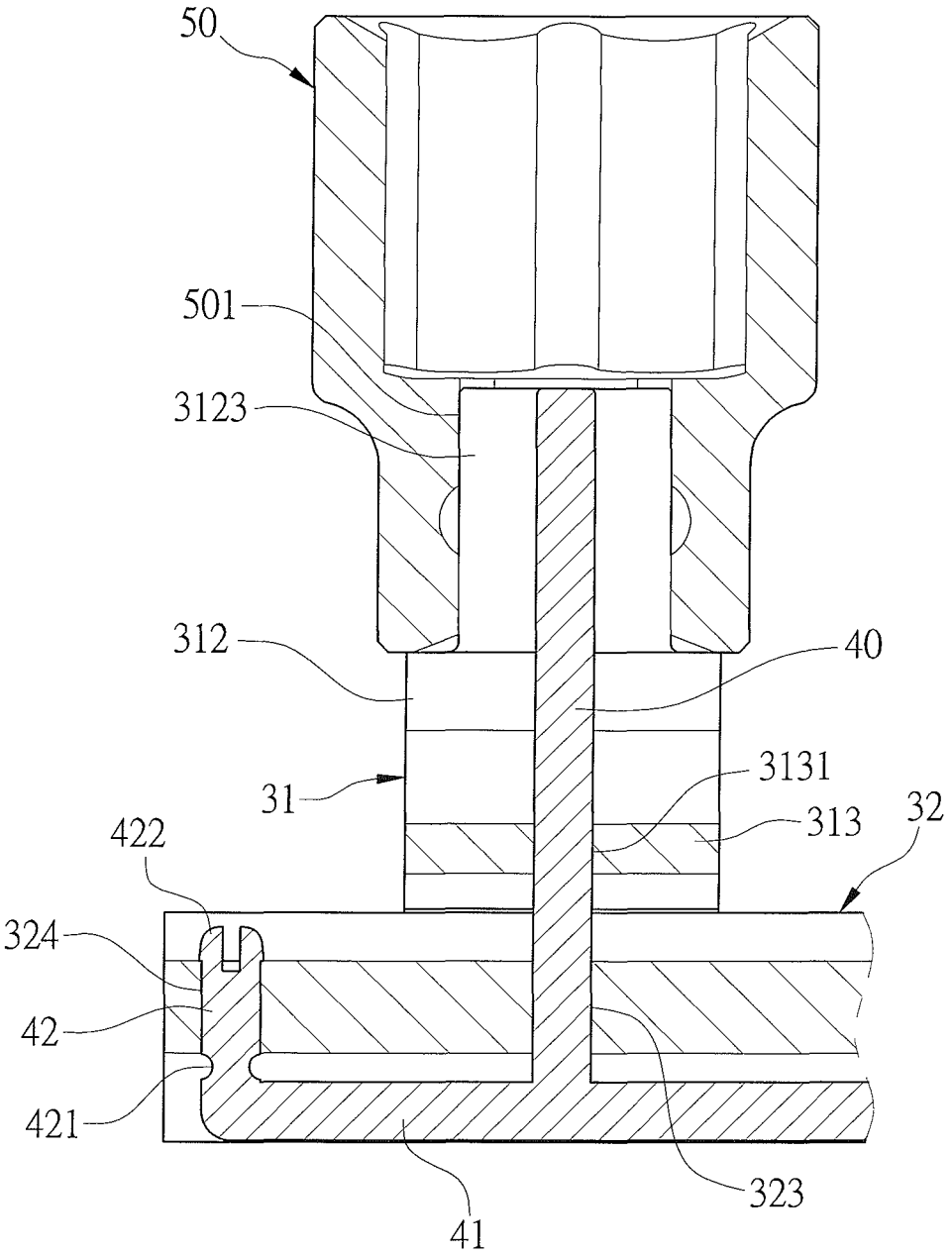

With reference to FIG. 8, the socket 50 is rotated 45 degrees, so that two of the four retaining recesses 502 correspond to the first locking projection 3114 and the second locking projection 3124 individually. Referring further to FIG. 9, when stopping pressing the socket 50, the first fitting portion 3113 and the first locking projection 3114 of the first side plate 311 and the second fitting portion 3123 and the second locking projection 3124 of the second side plate 312 return back to their original positions respectively. Hence, the first locking projection 3114 and the second locking projection 3124 individually retain with the two retaining recesses 502, thus fitting the socket 50 with the connector 30. Referring further to FIGS. 10 and 11, the fixer 40 is inserted into the multiple orifices 323 of the fixing mount 32 and the through hole 3131 of the connection plate 313. Each notch 324 of the fixing mount 32 accommodates the flexible fastening tab 422 of each vertical column 42, so that the fixer 40 is fixed in the cavity 302 of the connector 30, and so that the fixer 40 limits the inward deformation of the first fitting portion 3113 of the first side plate 311 and the second fitting portion 3123 of the second side plate 312. The first locking projection 3114 of the first fitting portion 3113 and the second locking projection 3124 of the second fitting portion 3123 retain the two retaining recesses 502 of the socket 50. Hence, the socket 50 is not removed from the first fitting portion 3113 of the first side plate 311 and the second fitting portion 3123 of the second side plate 312 to obtain anti-theft effect.

Figure 12:
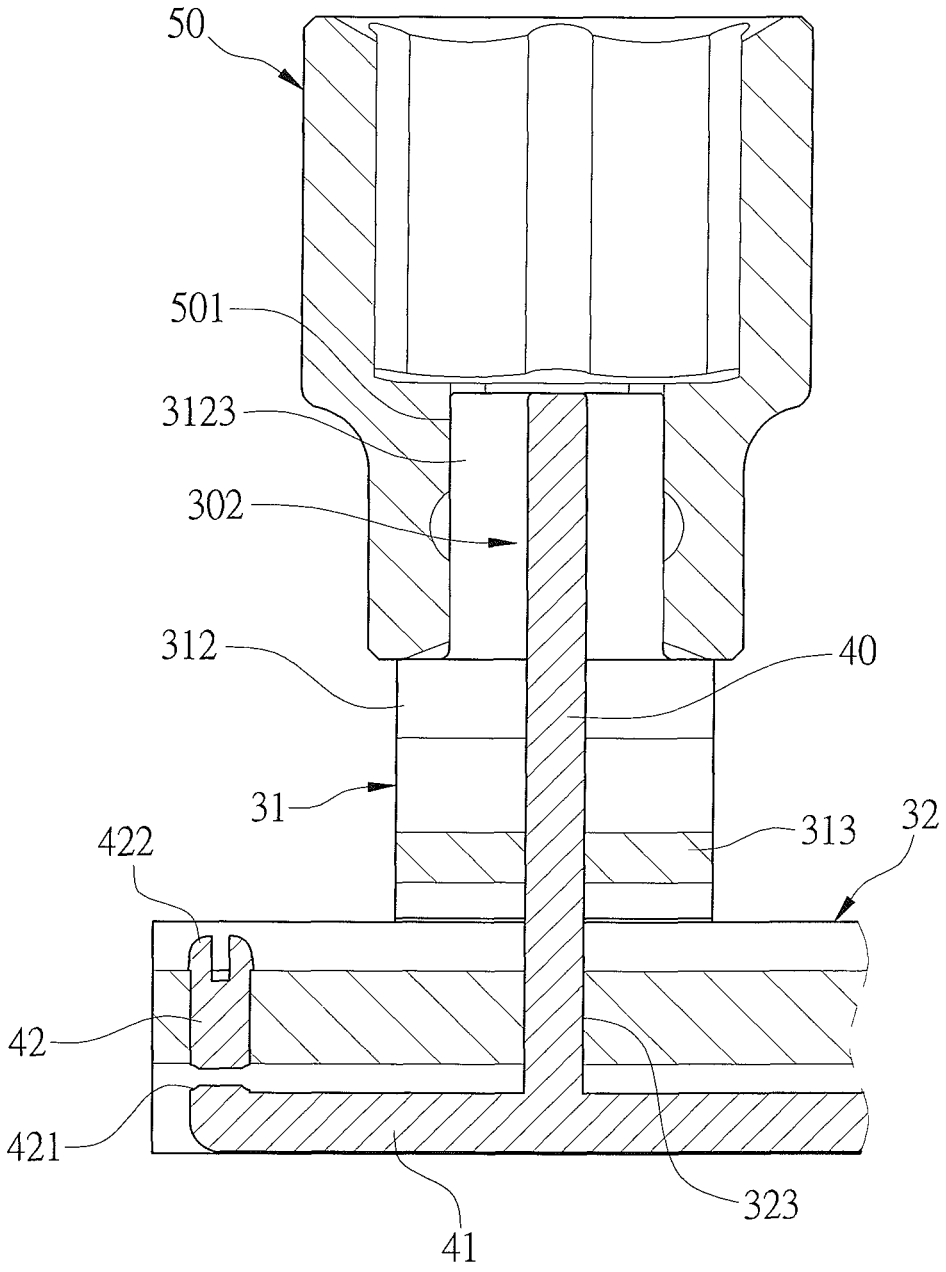
Figure 13:
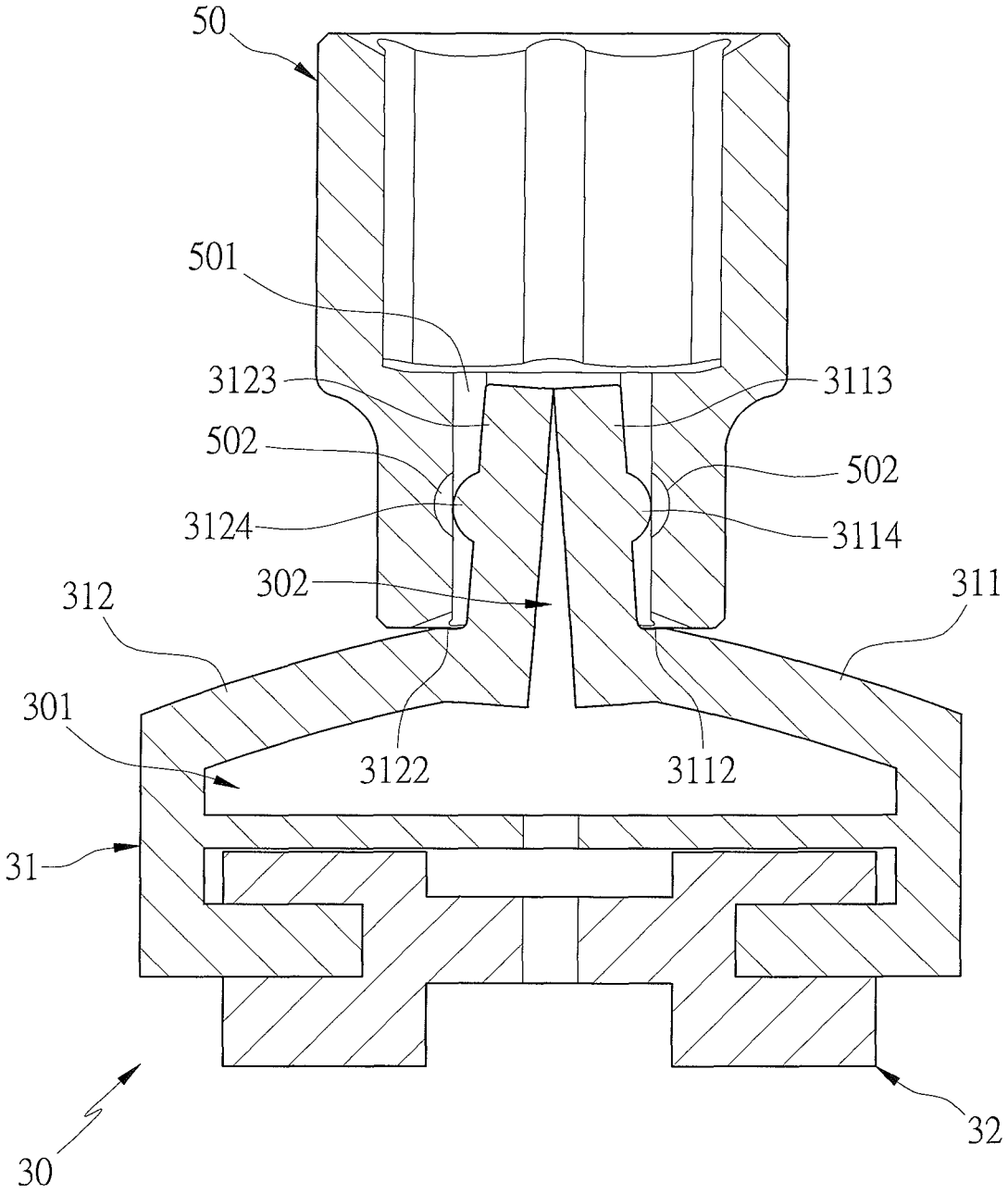
Figure 14:
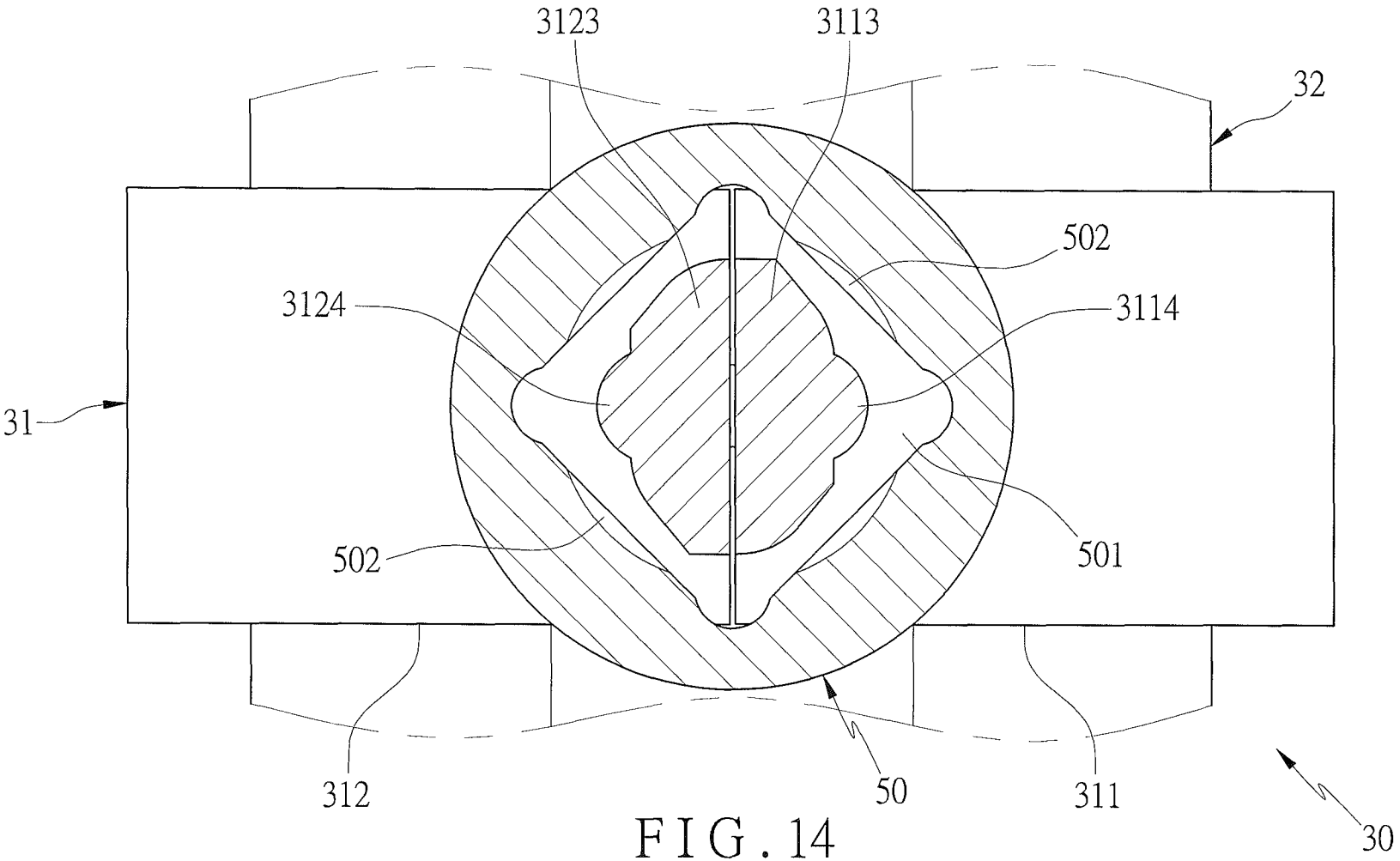
Figure 15:
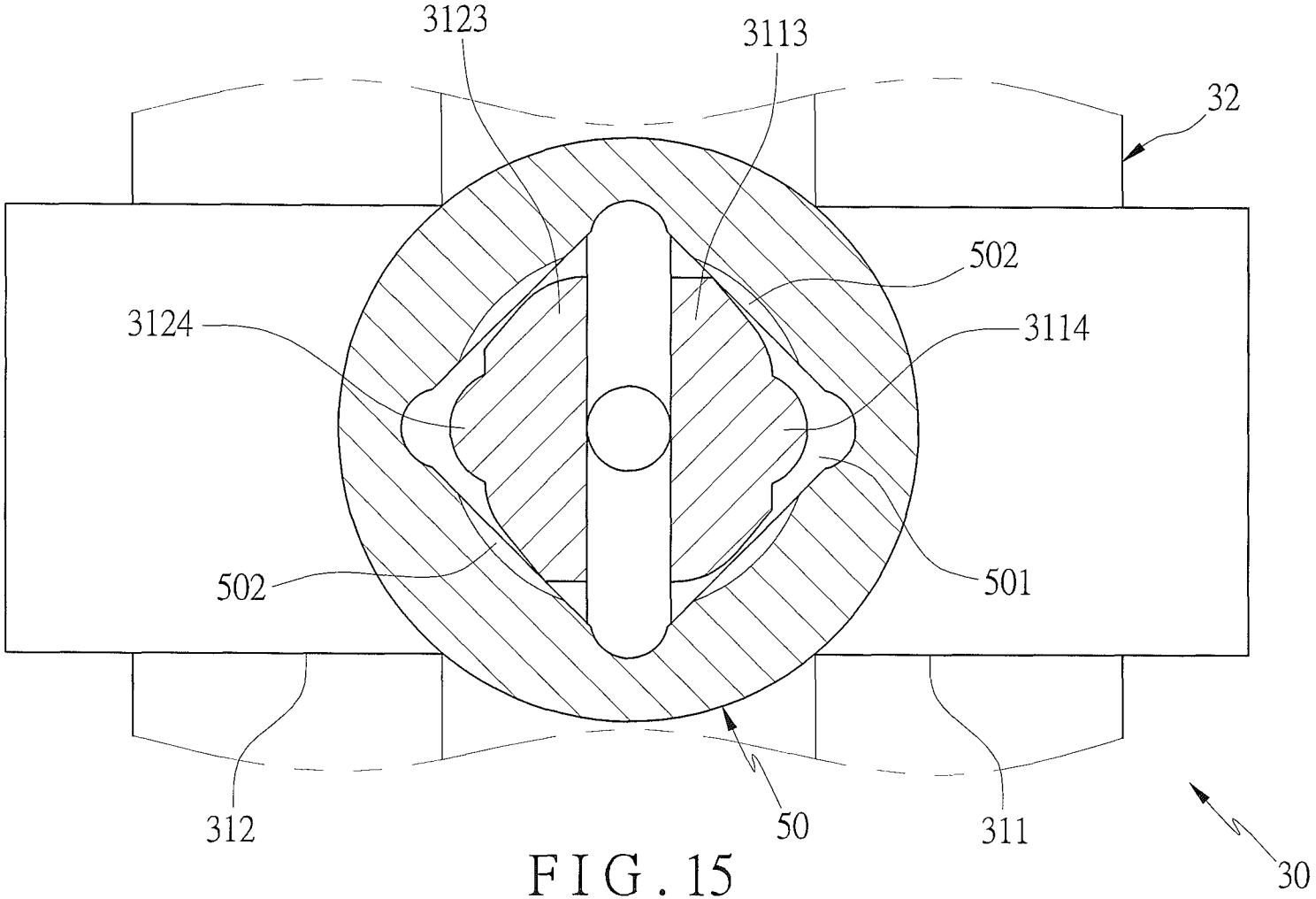

As shown in FIGS. 12 and 13, the neck 421 of each vertical column 42 is cut, so that the fixer 40 is removed from the cavity 302 of each body 31, and the inward deformation of the first fitting portion 3113 of the first side plate 311 and the second fitting portion 3123 of the second side plate 312 is released. Thereafter, the socket 50 is pressed to abut against the first stop portion 3112 of the first side plate 311 and the second stop portion 3122 of the second side plate 312, the first side plate 311 and the second side plate 312 drive the first fitting portion 3113 and the second fitting portion 3123 to deform inwardly, and the first locking projection 3114 and the second locking projection 3124 retract into the fitting zone defined by the first fitting portion 3113 and the second fitting portion 3123. Hence, the first locking projection 3114 and the second locking projection 3124 are removed from the two retaining recesses 502 of the socket 50 individually. With reference to FIG. 14, the first locking projection 3114 and the second locking projection 3124 retract into the fitting zone defined by the first fitting portion 3113 and the second fitting portion 3123, so the socket 50 is rotated 45 degrees easily. Preferably, the first fitting portion 3113 has the two first tilted faces 3115, and the second fitting portion 3123 has the two second tilted faces 3125, so the socket 50 is rotated 45 degrees so that the two diagonal corners of the square hole 501 of the socket 50 are revolved to correspond to the first locking projection 3114 and the second locking projection 3124 respectively. Referring to FIG. 15, when stopping pressing the socket 50, the first fitting portion 3113 and the first locking projection 3114 of the first side plate 311 and the second fitting portion 3123 and the second locking projection 3124 of the second side plate 312 return back to their original positions individually. Due to the first locking projection 3114 and the second locking projection 3124 corresponding to the two diagonal corners of the square hole 501 of the socket 50, and due to the distance between the two diagonal corners of the square hole 501 being more than the extending distance of each of the first locking projection 3114 and the second locking projection 3124, the first locking projection 3114 and the second locking projection 3124 do not retain with the socket 50. Hence, the socket 50 is removed easily.

Figure 16:
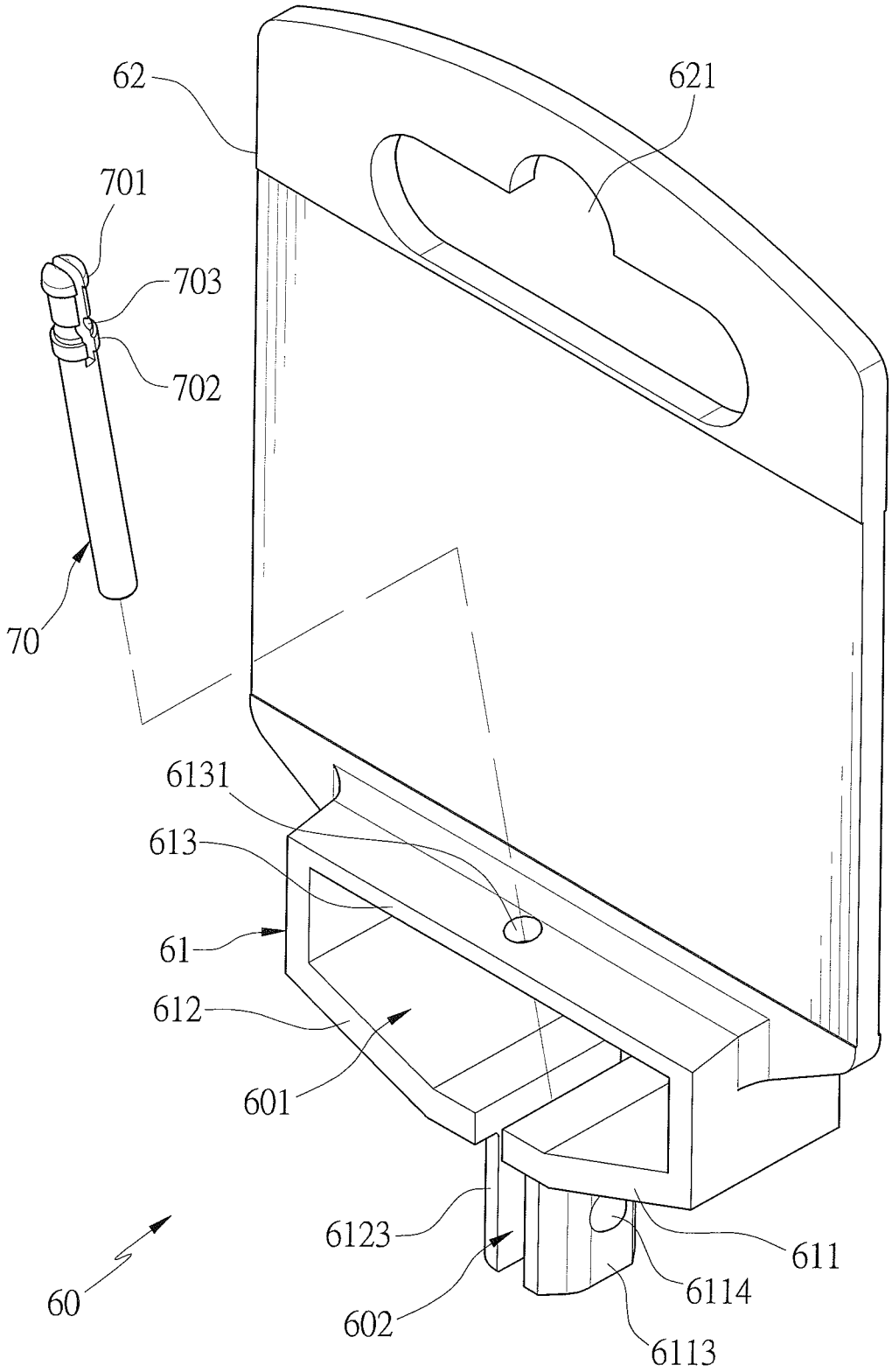
FIG. 16 is a perspective view showing the exploded components of a tool holder according to a second embodiment of the present invention.
Figure 17:
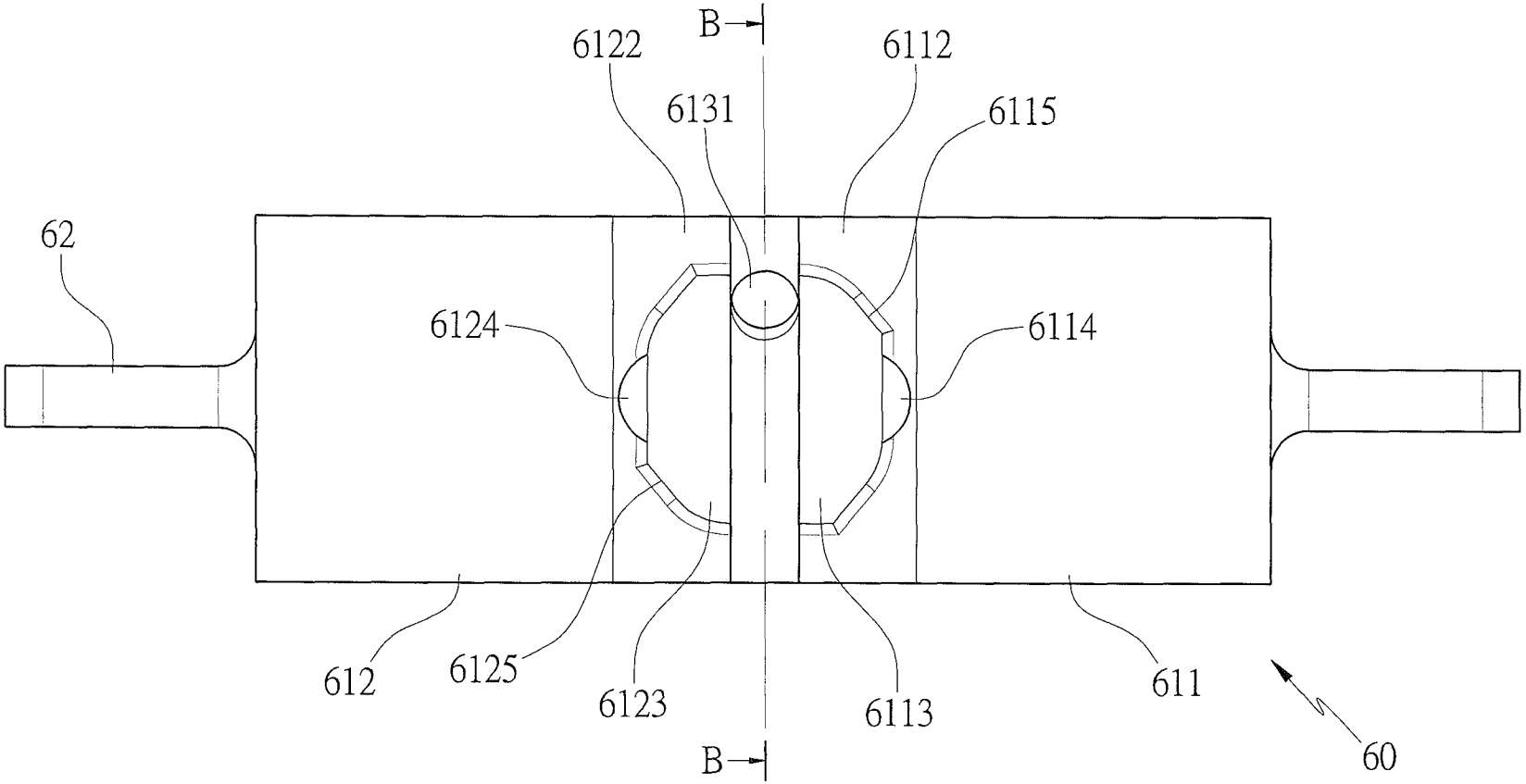
FIG. 17 is a side plan view showing the assembly of a part of the tool holder according to the second embodiment of the present invention.
Figure 18:
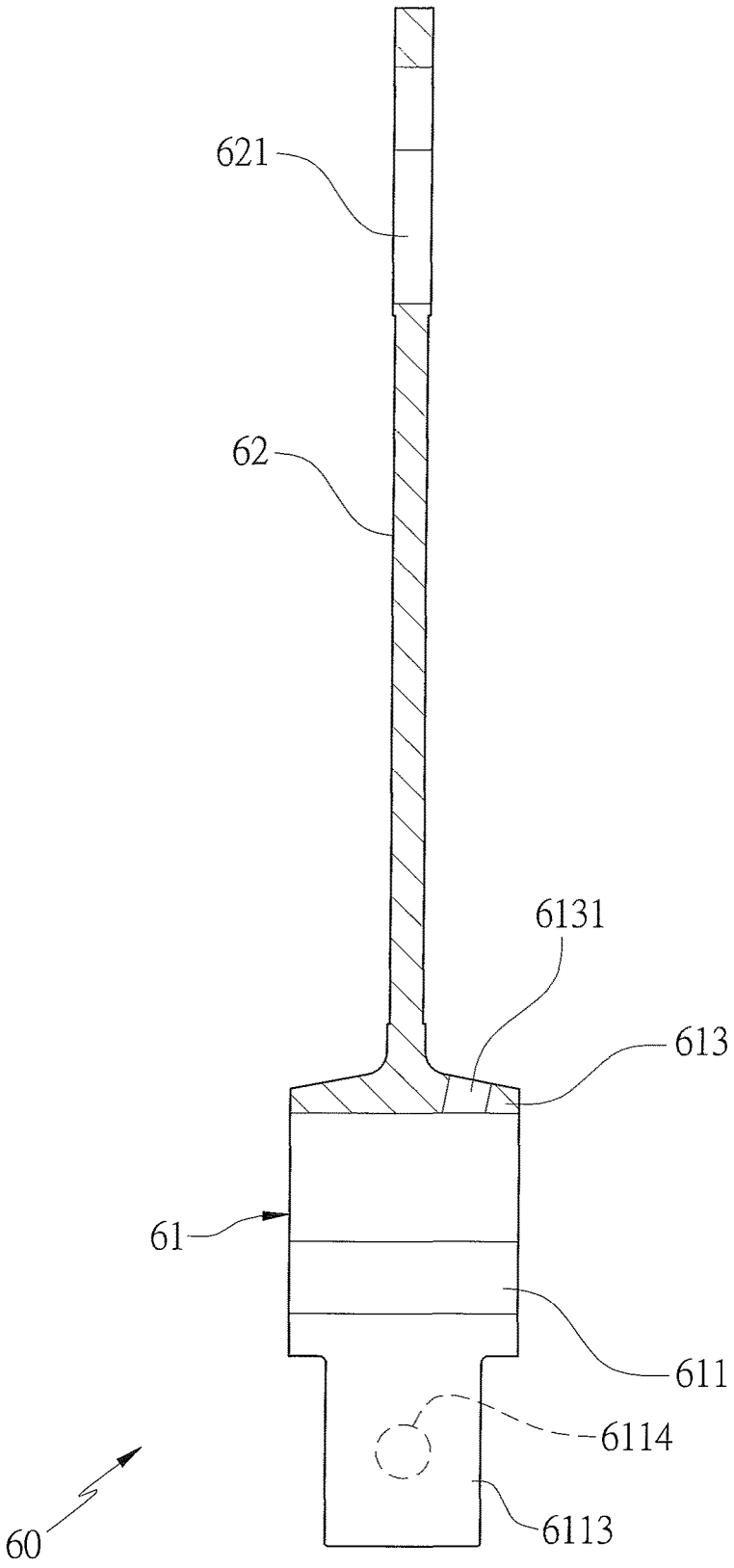
FIG. 18 is a cross sectional view taken along the line B-B of FIG. 17.

With reference to FIGS. 16 to 18, a tool holder according to a second embodiment of the present invention comprises: a connector 60 and a fixer 70.

The connector 60 includes at least one body 61, and each of the at least one body 61 has a first side plate 611, a second side plate 612, and a connection plate 613 connecting with a first end of the first side plate 611 and a first end of the second side plate 612. In this embodiment, the first end of the first side plate 611 and the first end of the second side plate 612 are integrally connected with a fixing mount 62, and the fixing mount 62 has a hanging aperture 621 defined away from the connection plate 613. The first side plate 611 and the second side plate 612 of said each body 61 obliquely extend inward. The first side plate 611 also has a first stop portion 6112 formed on a second end thereof and has a first fitting portion 6113 extending upwardly from the first stop portion 6112, and the second side plate 612 also has a second stop portion 6122 formed on a second end thereof and has a second fitting portion 6123 extending upwardly from the second stop portion 6122. The first fitting portion 6113 and the second fitting portion 6123 define a square fitting zone for fitting a tool. The first side plate 611 further has a first locking projection 6114 arranged on the first fitting portion 6113 thereof and extending out of the fitting zone defined by the first fitting portion 6113 and the second fitting portion 6123. In this embodiment, the second side plate 612 has a second locking projection 6124 arranged on the second fitting portion 6123 thereof and corresponding to the first locking projection 6114. When the first fitting portion 6113 and the second fitting portion 6123 fit with the tool, the first stop portion 6112 and the second stop portion 6122 limit the tool, and the first locking projection 6114 and the second locking projection 6124 engage the tool.

The first fitting portion 6113 has two first tilted faces 6115 defined on two edges of an outer rim thereof respectively, and the second fitting portion 6123 has two second tilted faces 6125 defined on two edges of an outer rim thereof respectively to guide the tool to rotate 45 degrees. Among the first side plate 611, the second side plate 612, and the connection plate 613 is defined a chamber 601, and between the first fitting portion 6113 and the second fitting portion 6123 is defined a cavity 602, so that the first side plate 611 and the second side plate 612 are forced to drive the first fitting portion 6113 and the second fitting portion 6123 to deform inwardly, and so that the first locking projection 6114 and the second locking projection 6124 retract into the fitting zone defined by the first fitting portion 6113 and the second fitting portion 6123, thus releasing the tool.

The fixer 70 is housed in the cavity 602 of the connector 60 to limit the inward deformation of the first fitting portion 6113 of the first side plate 611 and the second first fitting portion 6123 of the second side plate 612. The first locking projection 6114 and the second locking projection 6124 engage the tool, thus obtaining the anti-theft effect of the tool.

In this embodiment, the connection plate 613 has a through hole 6131 tilting toward the first fitting portion 6113 and the second fitting portion 6123 to accommodate the fixer 70. The fixer 70 includes a first flexible fastening tab 701 and a second flexible fastening tab 702 formed on one end of the fixer 70 adjacent to the hanging aperture 621, and between the first flexible fastening tab 701 and the second flexible fastening tab 702 is defined a neck 703. The first flexible fastening tab 701 and the second flexible fastening tab 702 retain with the through hole 6131 of the connection plate 613, so that the fixer 70 is housed in the cavity 602 of the connector 60, and so that the inward deformation of the first fitting portion 6113 and the second fitting portion 6123 is limited by the fixer 70, thus obtaining the anti-theft effect.

Figure 19:
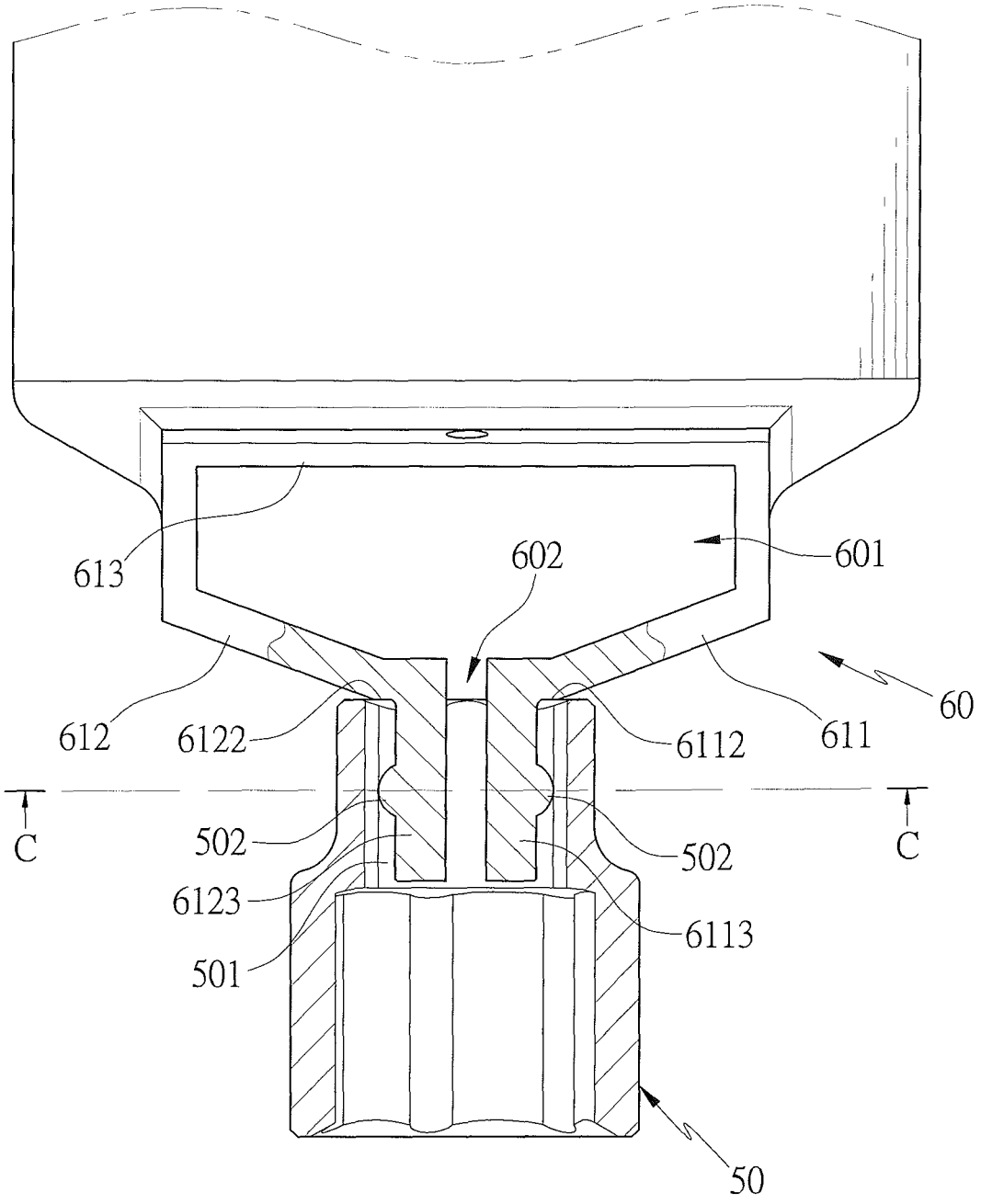
FIG. 19 is a cross sectional view showing the operation of a part of the tool holder according to the second embodiment of the present invention.
Figure 20:
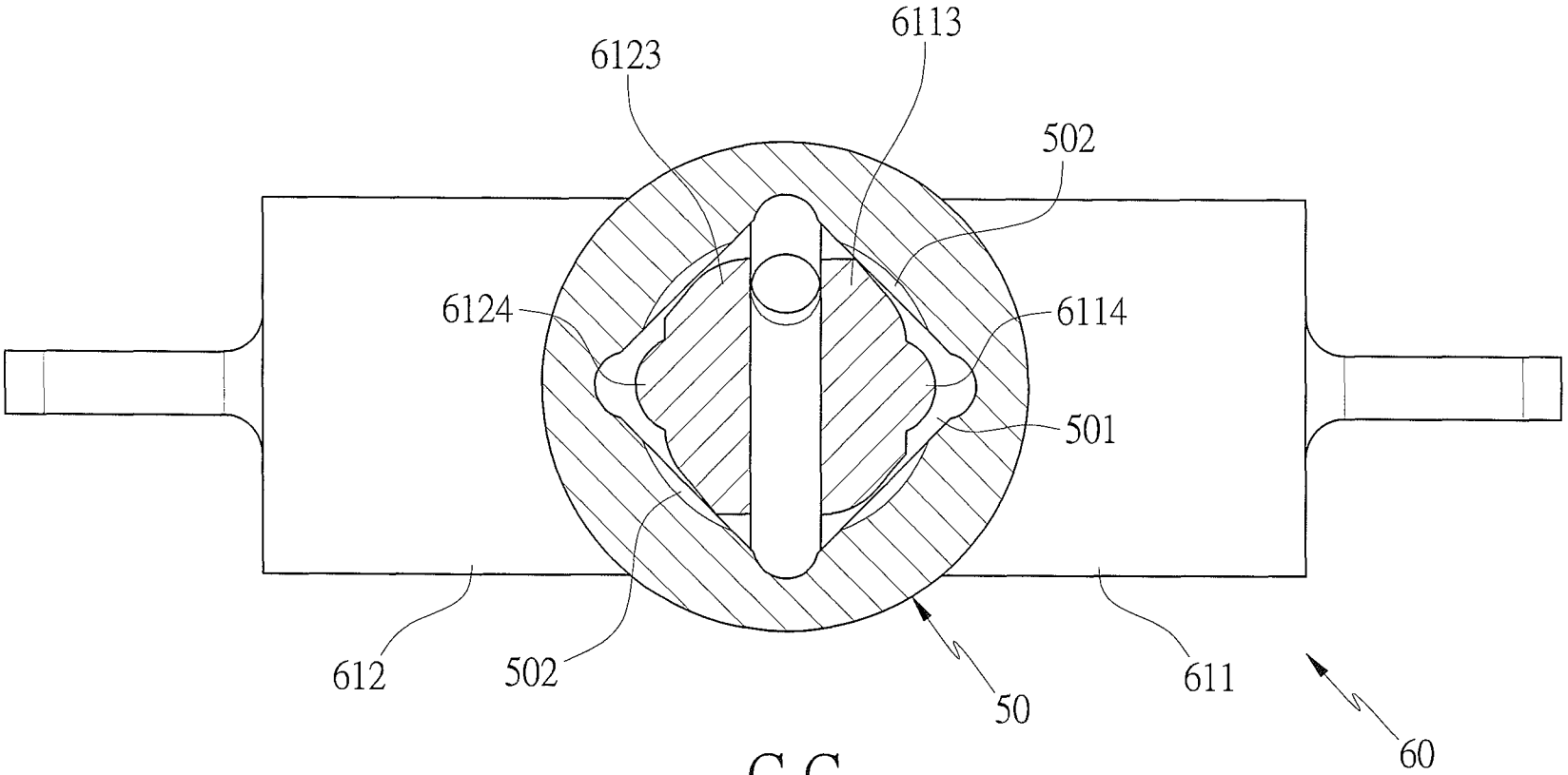
FIG. 20 is a cross sectional view taken along the line C-C of FIG. 19.
Figure 21:
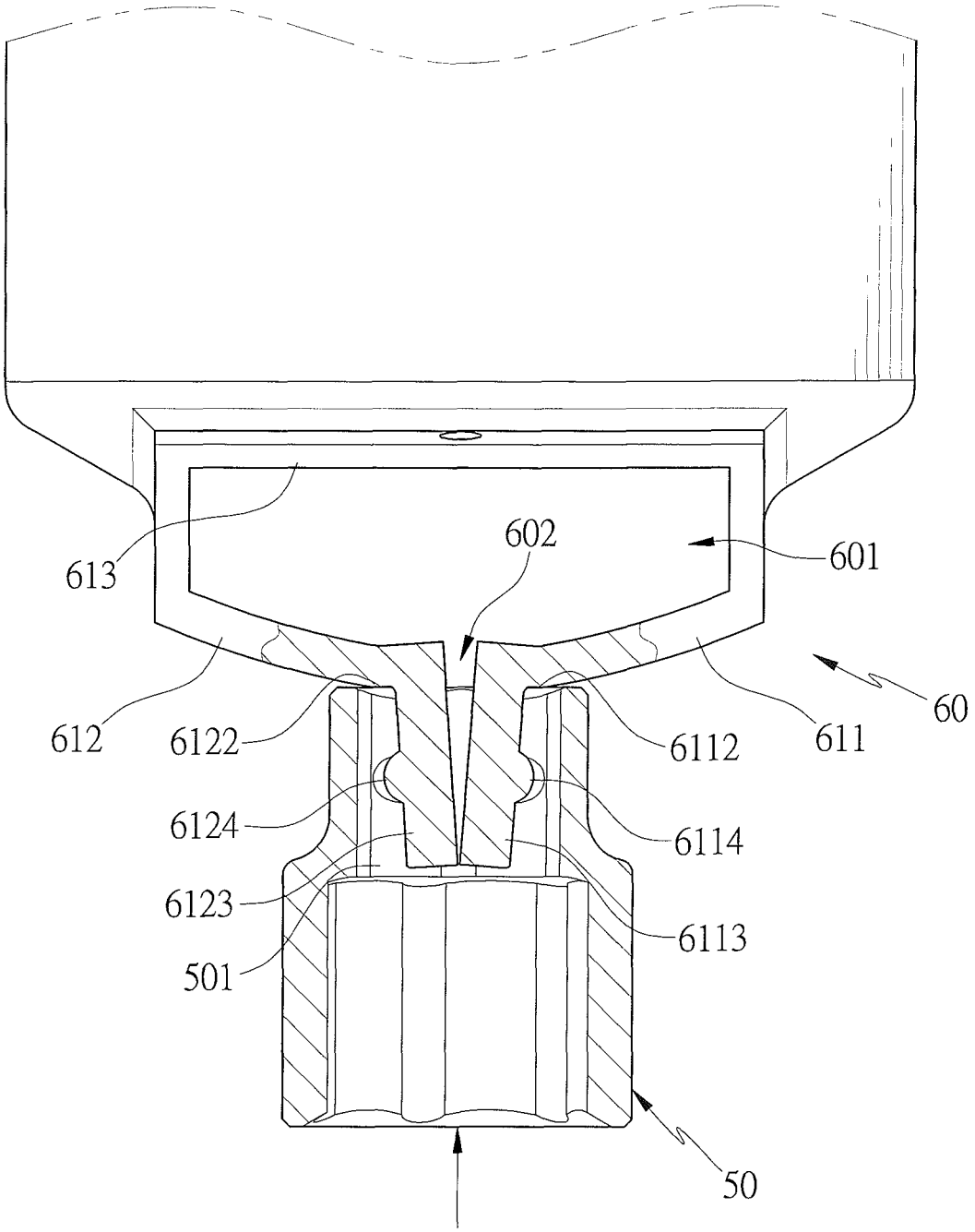
FIGS. 21 to 29 are cross sectional views respectively showing the operation of the tool holder according to the second embodiment of the present invention.

Referring to FIGS. 19 and 20, when two diagonal corners of the square hole 501 of the socket 50 correspond to the first locking projection 6114 and the second locking projection 6124, a distance between the two diagonal corners of the socket 50 is more than an extending length of each of the first locking projection 6114 and the second locking projection 6124, so the square hole 501 of the socket 50 fits with the first fitting portion 6113 and the second fitting portion 6123. Referring to FIG. 21, when stopping pressing the socket 50, the socket 50 abuts against the first stop portion 6112 of the first side plate 611 and the second stop portion 6122 of the second side plate 612, so that the first side plate 611 and the second side plate 612 drive the first fitting portion 6113 and the second fitting portion 6123 to deform inwardly. Hence, the first locking projection 6114 and the second locking projection 6124 retract into the fitting zone defined by the first fitting portion 6113 and the second fitting portion 6123.

Figure 22:
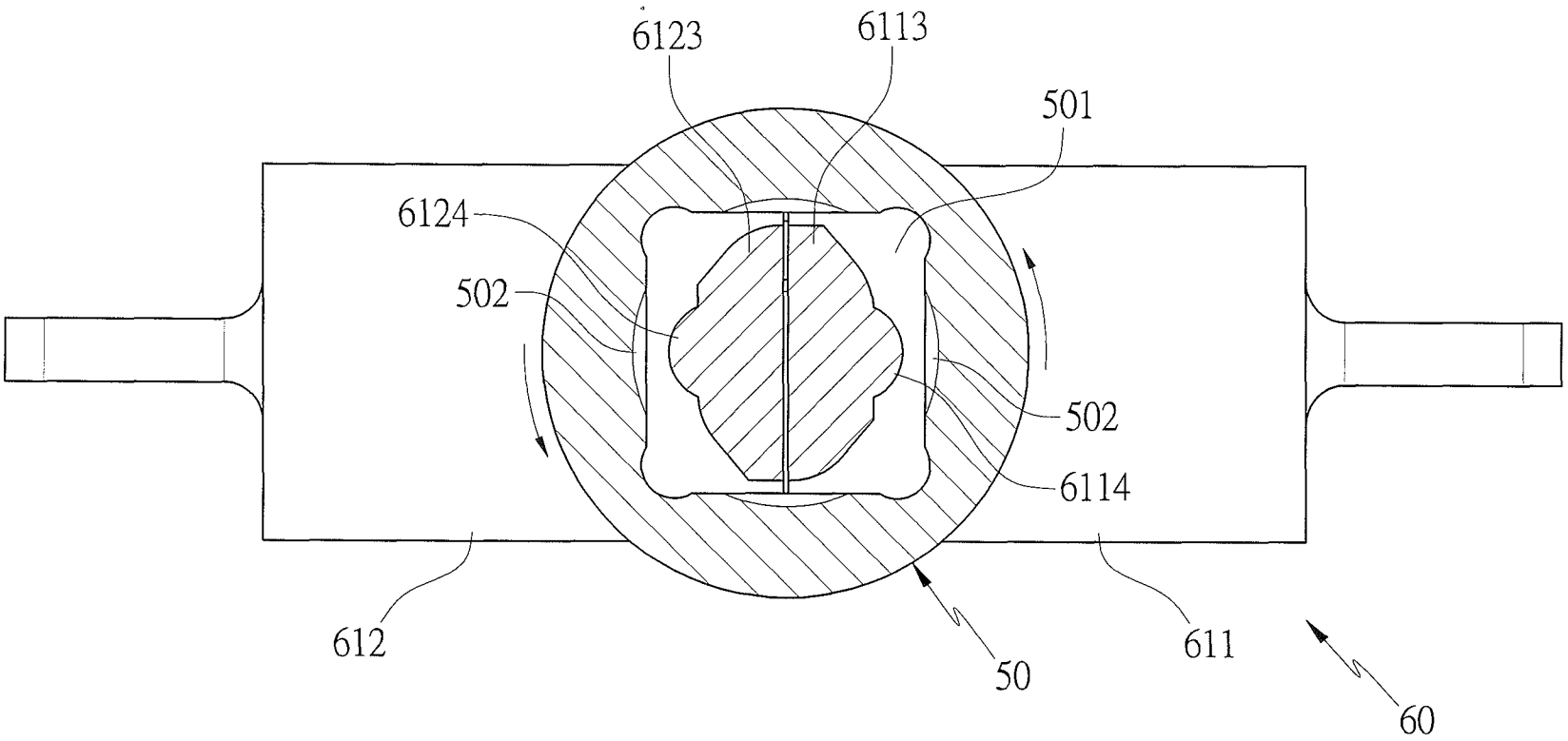
Figure 23:
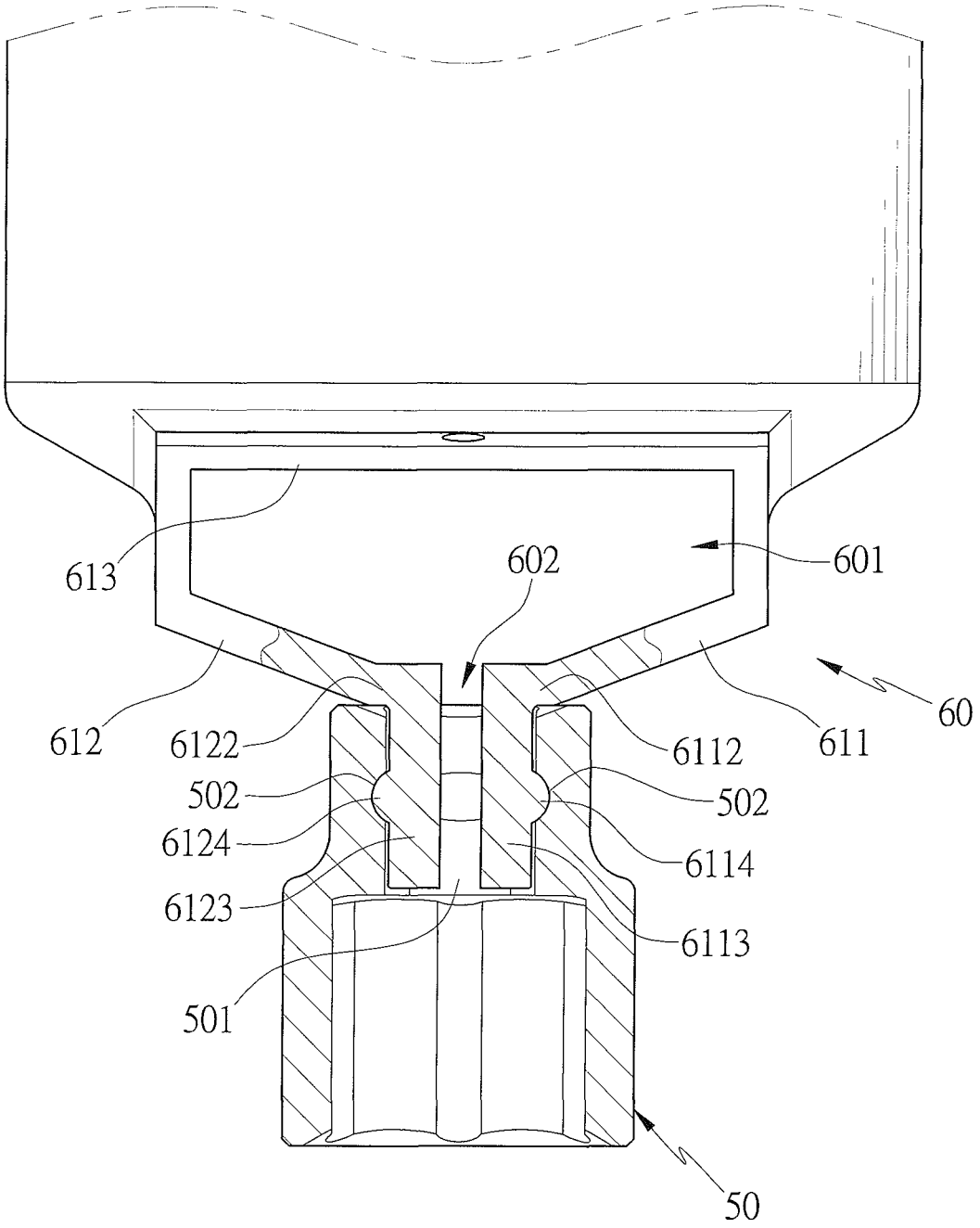
Figure 24:
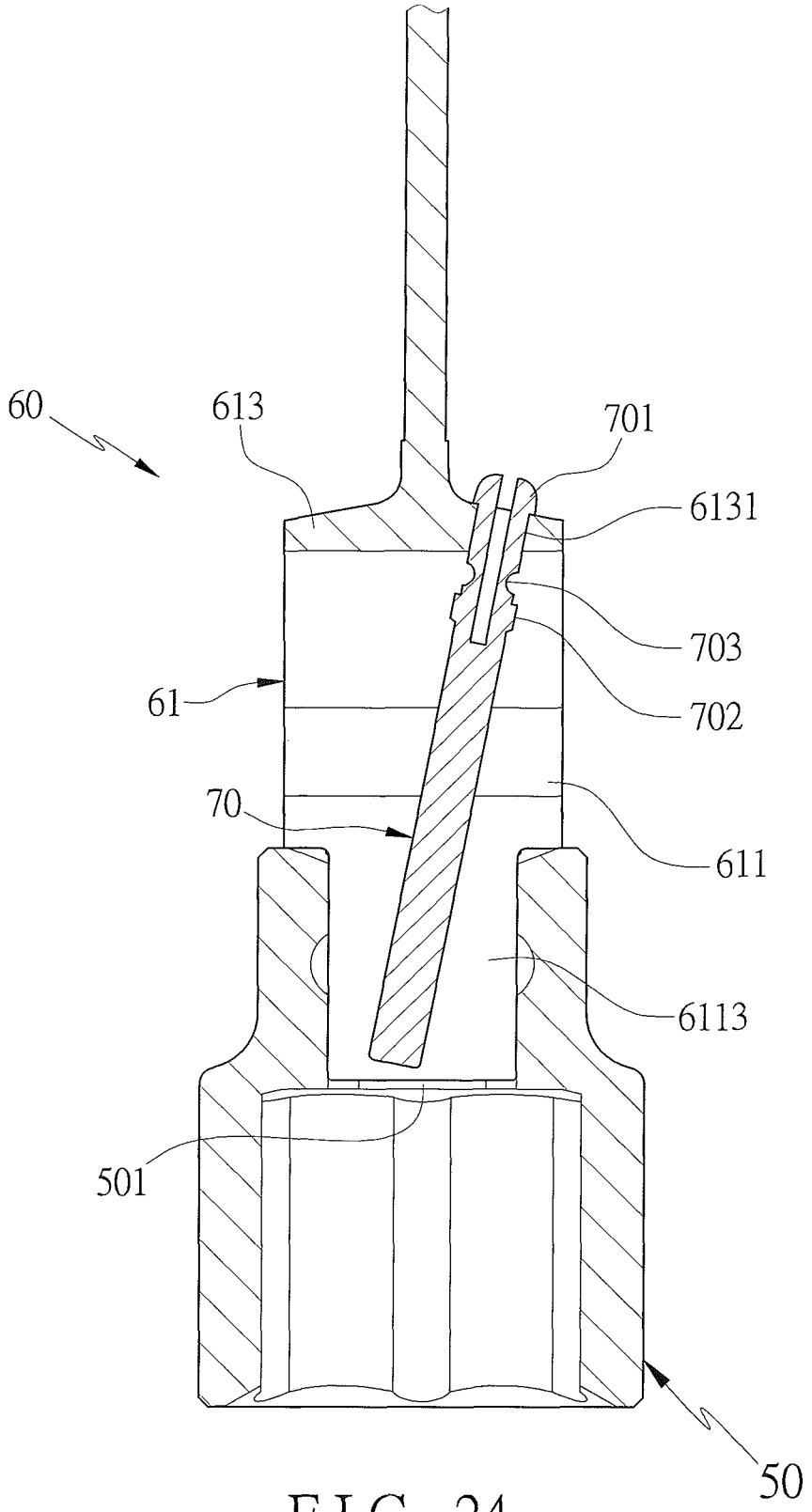
Figure 25:
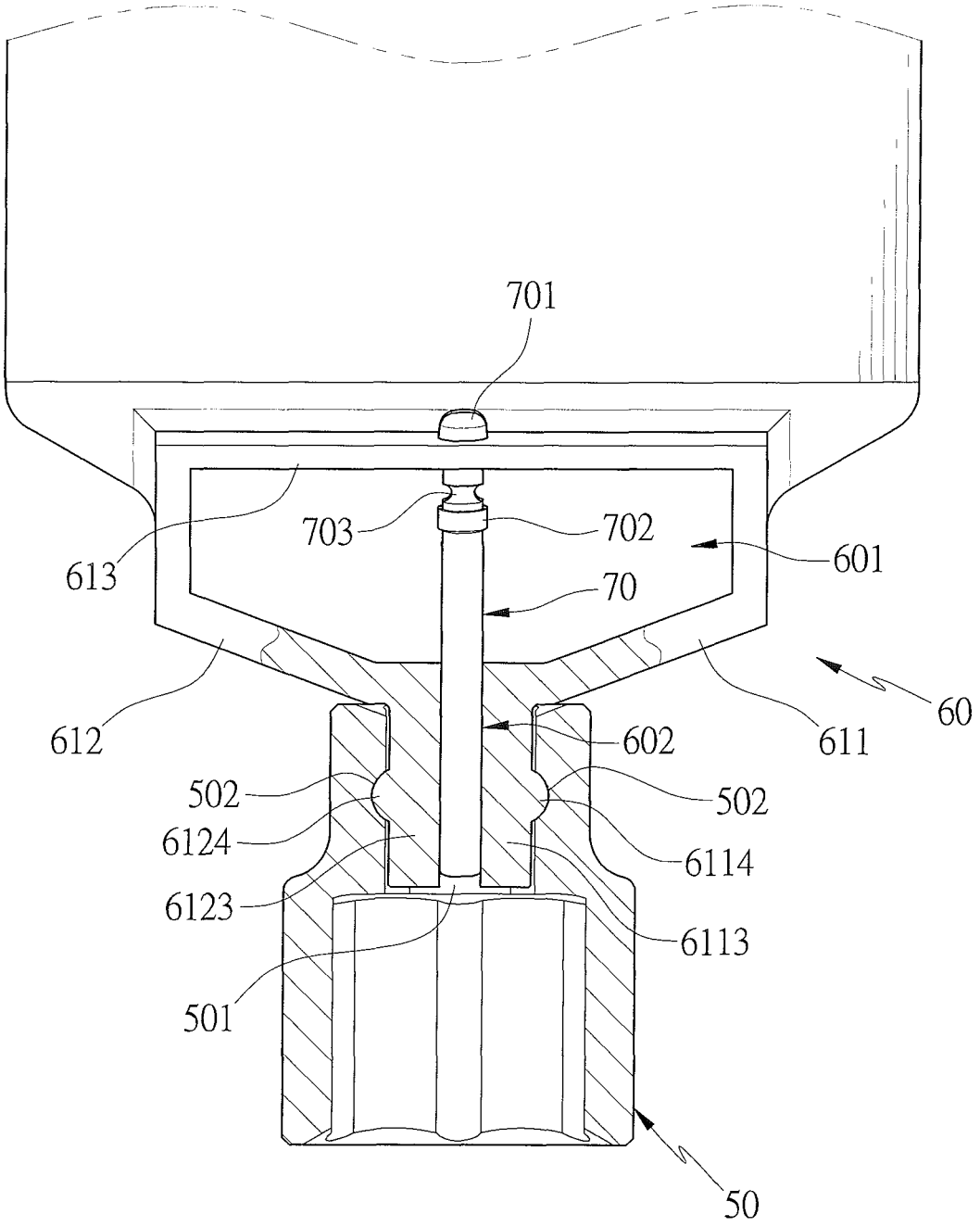

With reference to FIG. 22, the socket 50 is rotated 45 degrees, so that two of the four retaining recesses 502 correspond to the first locking projection 6114 and the second locking projection 6124 individually. Referring further to FIG. 23, when stopping pressing the socket 50, the first fitting portion 6113 and the first locking projection 6114 of the first side plate 611 and the second fitting portion 6123 and the second locking projection 6124 of the second side plate 612 return back to their original positions respectively. Hence, the first locking projection 6114 and the second locking projection 6124 individually retain with the two retaining recesses 502 of the socket 50, thus fitting the socket 50 with the connector 60. Referring further to FIGS.

24 and 25, the fixer 70 is inserted into the through hole 6131 of the connection plate 613. The first flexible fastening tab 701 and the second flexible fastening tab 702 of the fixer 70 retain with the through hole 6131 of the connection plate 613, and the fixer 70 is fixed in the cavity 602 of the connector 60, so that the fixer 70 limits the inward deformation of the first fitting portion 6113 of the first side plate 611 and the second fitting portion 6123 of the second side plate 612, and so that the first locking projection 6114 of the first fitting portion 6113 and the second locking projection 6124 of the second fitting portion 6123 retain the two retaining recesses 502 of the socket 50. Hence, the socket 50 is not removed from the first fitting portion 6113 and the second fitting portion 6123 to obtain the anti-theft effect of the socket 50.

Figure 26:
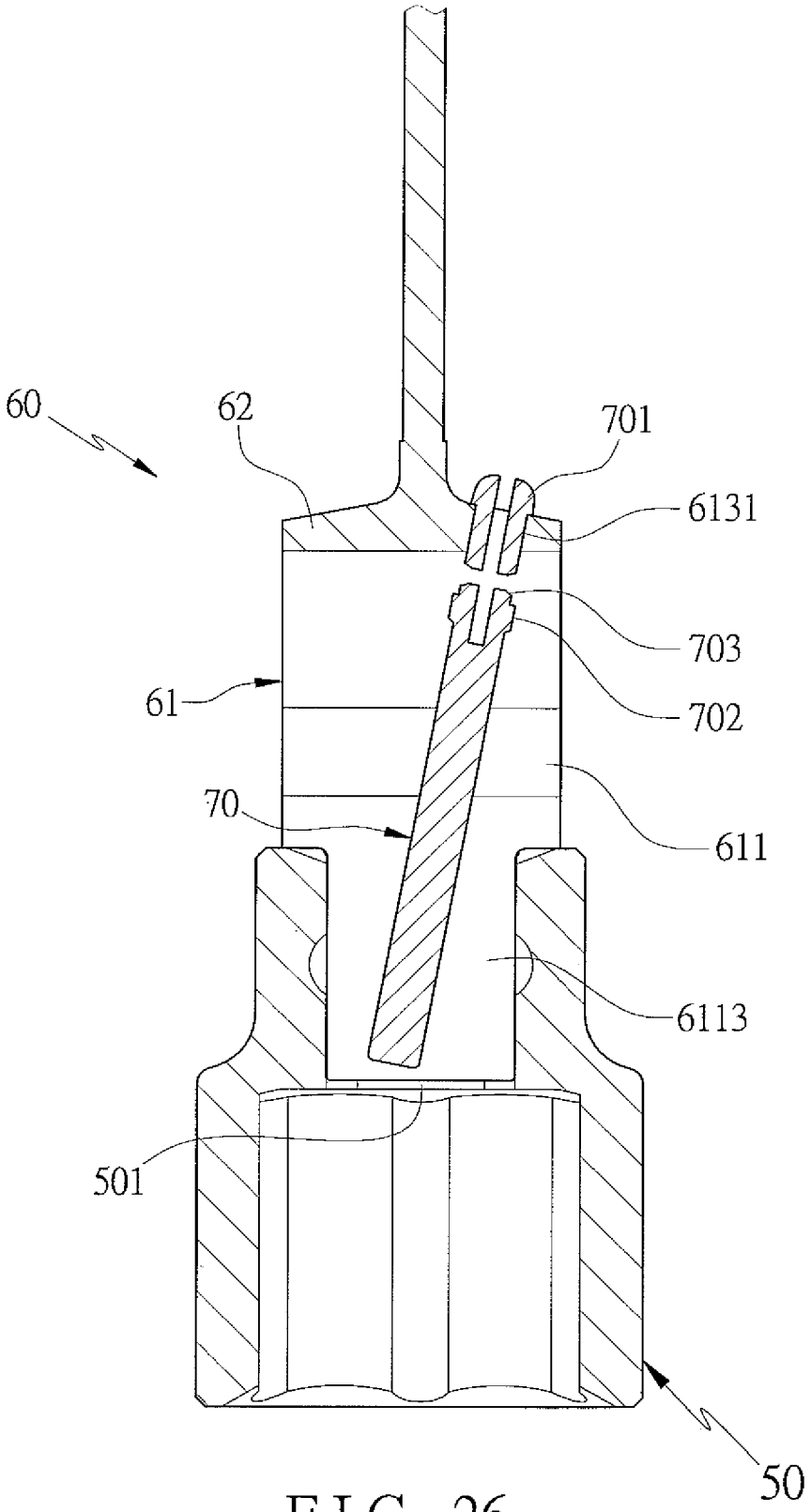
Figure 27:
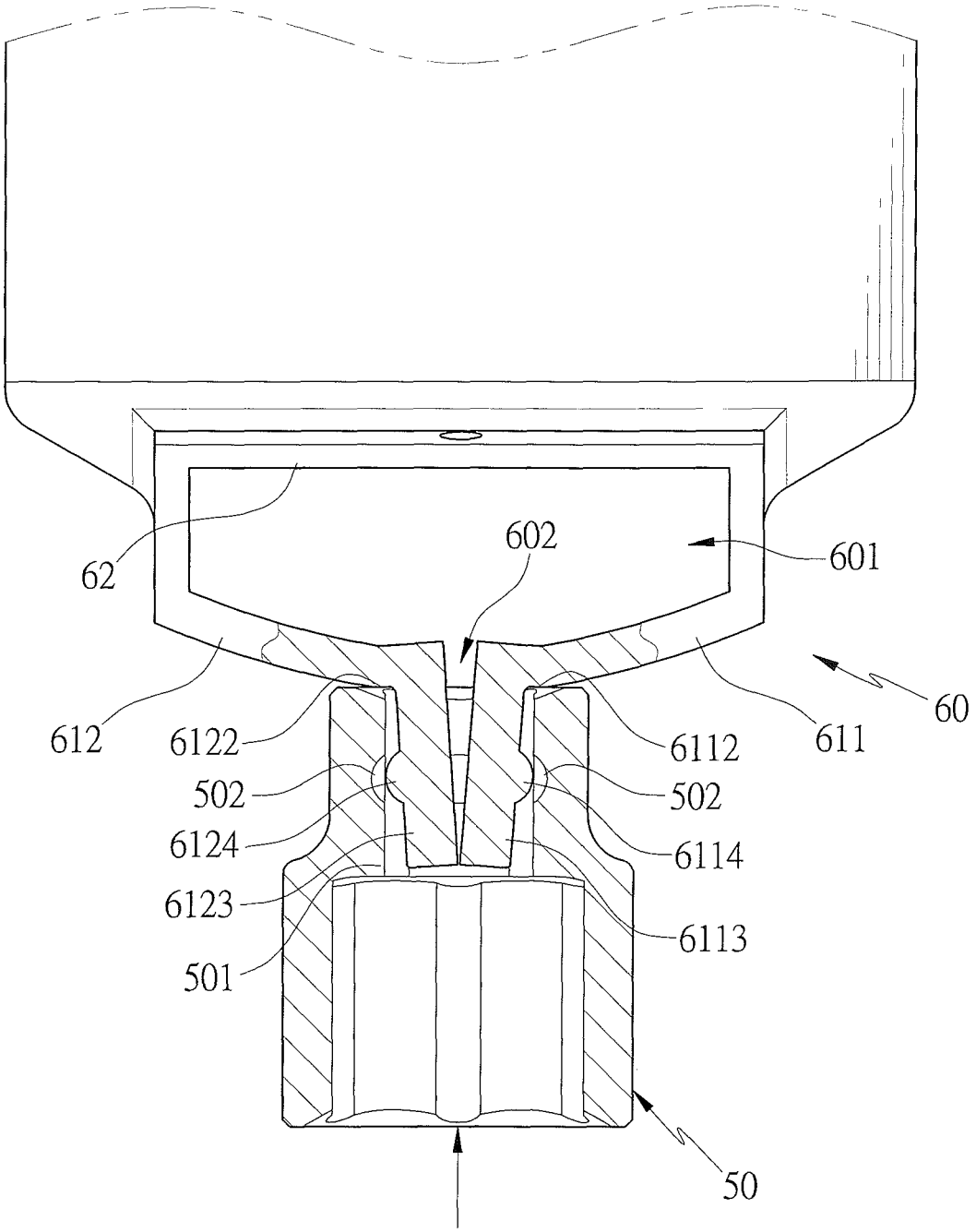

As shown in FIGS. 26 and 27, the neck 703 of the fixer 70 is cut so that the fixer 70 is removed from the cavity 602 of the connector 60, and so that the inward deformation of the first fitting portion 6113 of the first side plate 611 and the second fitting portion 6123 of the second side plate 612 is released. Thereafter, the socket 50 is pressed to abut against the first stop portion 6112 of the first side plate 611 and the second stop portion 6122 of the second side plate 612, the first side plate 611 and the second side plate 612 drive the first fitting portion 6113 and the second fitting portion 6123 to move inwardly, and the first locking projection 6114 and the second locking projection 6124 retract into the fitting zone defined by the first fitting portion 6113 and the second fitting portion 6123. Hence, the first locking projection 6114 and the second locking projection 6124 are removed from the two retaining recesses 502 of the socket 50 individually.

Figure 28:
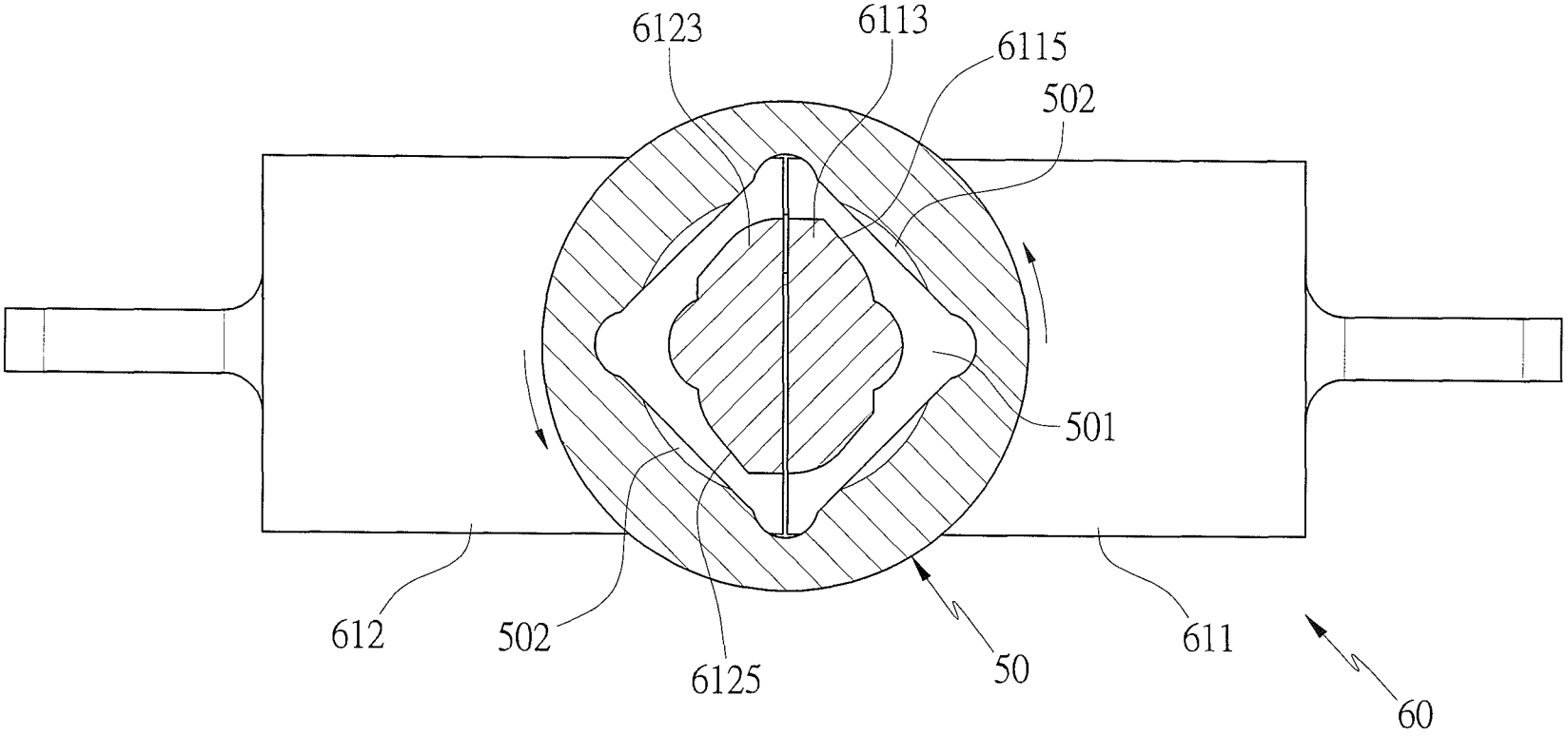
Figure 29:
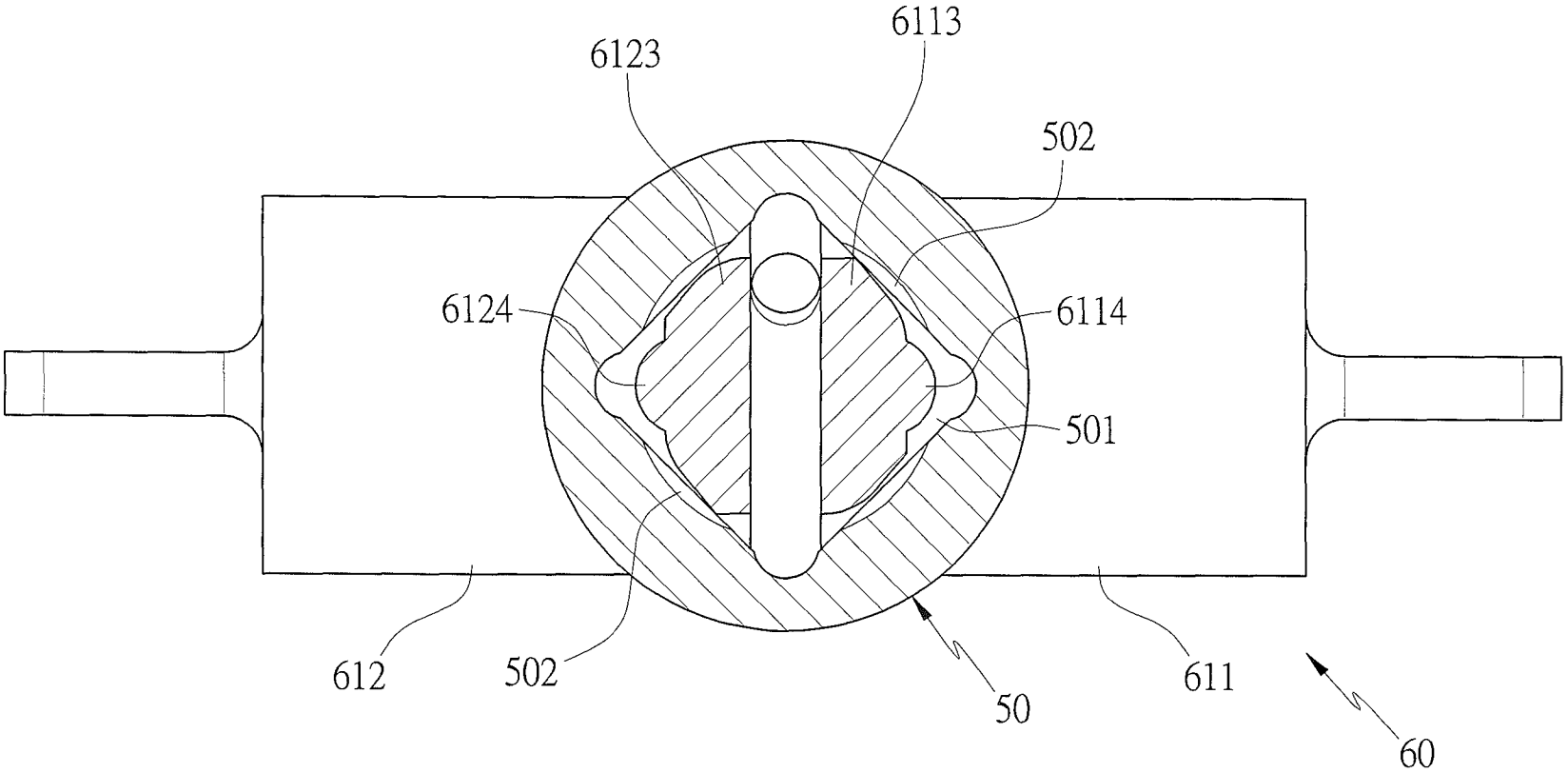

With reference to FIG. 28, the first locking projection 6114 and the second locking projection 6124 retract into the fitting zone defined by the first fitting portion 6113 and the second fitting portion 6123, so the socket 50 is rotated 45 degrees easily. Preferably, the first fitting portion 6113 has the two first tilted faces 6115, and the second fitting portion 6123 has the two second tilted faces 6125. Hence, the socket 50 is rotated 45 degrees, so that the two diagonal corners of the square hole 501 of the socket 50 are revolved to correspond to the first locking projection 6114 and the second locking projection 6124 respectively. Referring to FIG. 29, when stopping pressing the socket 50, the first fitting portion 6113 and the first locking projection 6114 of the first side plate 611 and the second fitting portion 6123 and the second locking projection 6124 of the second side plate 612 return back to their original positions individually. Due to the first locking projection 6114 and the second locking projection 6124 corresponding to the two diagonal corners of the square hole 501 of the socket 50, and due to the distance between the two diagonal corners of the square hole 501 being more than the extending distance of each of the first locking projection 6114 and the second locking projection 6124, the first locking projection 6114 and the second locking projection 6124 do not retain with the socket 50. Hence, the socket 50 is removed easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool holder comprising:

a connector including at least one body, with each of the at least one body having a first side plate including first and second ends, a second side plate including first and second ends, and a connection plate connecting with the first end of the first side plate and the first end of the second side plate, with the first side plate having a first fitting portion extending upwardly from the second end of the first side plate, with the second side plate having a second fitting portion extending upwardly from the second end of the second side plate, with the second ends of the first and second side plates being spaced and moveable relative to each other, with the first and second fitting portions being spaced and moveable relative to each other, wherein the first fitting portion and the second fitting portion define a fitting zone, wherein the first side plate further has a first locking projection arranged on the first fitting portion thereof and extending out of the fitting zone, wherein the first side plate, the second side plate, and the connection plate define a chamber, wherein the first fitting portion and the second fitting portion defines a cavity therebetween, wherein the first side plate and the second side plate are deformable inwardly toward the chamber, causing retraction toward the cavity of the first fitting portion and the second fitting portion and retraction toward the fitting zone of the first locking projection; and a fixer housed in the cavity of the connector to prohibit the retraction of the first fitting portion and the second fitting portion, wherein the connection plate has a through hole aligned with the cavity and accommodating the fixer.

2. The tool holder as claimed in claim 1, wherein the first end of the first side plate and the first end of the second side plate are in connection on a fixing mount.

3. The tool holder as claimed in claim 2, wherein the first side plate has a first extension bending inwardly from the first end thereof, wherein the second side plate has a second extension bending inwardly from the first end thereof, wherein the fixing mount has a first accommodation groove defined on a first side thereof to fit with the first extension, and the fixing mount has a second accommodation groove defined on a second side thereof to fit with the second extension.

4. The tool holder as claimed in claim 2, wherein the fixing mount further has multiple orifices, wherein each orifice is configured to align with the cavity and to accommodate the fixer, wherein the fixer includes a horizontal column extending from a bottom end thereof, wherein the fixer includes two vertical columns arranged on two edges of the horizontal column, wherein each of the two vertical columns has a neck formed on a first end thereof and has a flexible fastening tab arranged on a second end thereof, wherein the fixing mount has multiple notches, and wherein each of the multiple notches accommodates the flexible fastening tab of each vertical column.

5. The tool holder as claimed in claim 2, wherein the fixer includes a first flexible fastening tab and a second flexible fastening tab which form on one end of the fixer, wherein between the first flexible fastening tab and the second flexible fastening tab is defined a neck, and wherein the first flexible fastening tab and the second flexible fastening tab retain with the through hole of the connection plate.

6. The tool holder as claimed in claim 1, wherein the first end of the first side plate and the first end of the second side plate are connected with a fixing mount, and the fixing mount has a hanging aperture defined away from the connection plate.

7. The tool holder as claimed in claim 1, wherein the first side plate has a first stop portion formed on the second end thereof, and wherein the second side plate also has a second stop portion formed on the second end thereof.

8. The tool holder as claimed in claim 1, wherein the first fitting portion and the second fitting portion define the fitting zone in a square shape to fit a tool.

9. The tool holder as claimed in claim 1, wherein the first fitting portion has two first tilted faces defined on two edges of an outer rim thereof respectively, and wherein the second fitting portion has two second tilted faces defined on two edges of an outer rim thereof respectively.

* * * * *